US009396663B2

(12) United States Patent
Zimmer et al.

(10) Patent No.: US 9,396,663 B2
(45) Date of Patent: Jul. 19, 2016

(54) SYSTEMS AND METHODS OF AIRPORT TRAFFIC CONTROL

(71) Applicant: The Boeing Company, Chicago, IL (US)

(72) Inventors: Nico Zimmer, Neu-Isenburg (DE); Bo Vaaben, Espergaerde (DK); Krzysztof Pytel, Gdansk (PL); Brian A. Azcuenaga, Englewood, CO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/330,830

(22) Filed: Jul. 14, 2014

(65) Prior Publication Data

US 2016/0012737 A1 Jan. 14, 2016

(51) Int. Cl.
*G08G 5/00* (2006.01)
*G08G 5/06* (2006.01)

(52) U.S. Cl.
CPC ..... *G08G 5/065* (2013.01); *G08G 5/0013* (2013.01); *G08G 5/0021* (2013.01); *G08G 5/0082* (2013.01); *G08G 5/0026* (2013.01)

(58) Field of Classification Search
CPC ..... G08G 5/06; G08G 5/065; G08G 5/0013
See application file for complete search history.

(56) References Cited

U.S. PATENT DOCUMENTS 5,375,058 A * 12/1994 Bass ..... 701/120
5,835,059 A * 11/1998 Nadel ..... G01S 5/0027 342/37
6,006,158 A * 12/1999 Pilley ..... G01C 23/00 340/953
6,195,609 B1 * 2/2001 Pilley ..... G01C 23/00 342/36
6,246,342 B1 * 6/2001 Vandevoorde ..... G06Q 99/00 340/933
6,282,488 B1 * 8/2001 Castor ..... G08G 5/065 244/114 R
6,411,890 B1 * 6/2002 Zimmerman ..... B64F 1/002 340/952
7,117,089 B2 * 10/2006 Khatwa ..... G01S 19/15 340/471
7,222,017 B2 * 5/2007 Clark ..... G01C 23/00 340/958
7,343,229 B1 * 3/2008 Wilson ..... G08G 5/0021 340/951
7,414,545 B2 * 8/2008 Vickas ..... G08G 1/166 340/901

(Continued)

OTHER PUBLICATIONS

Advanced Surface Movement Guidance and Control System, retrieved from the Internet: http://en.wikipedia.org/wiki/Advanced_Surface_Movement_Guidance_a . . . ; From Wikipedia, the free encyclopedia; Feb. 20, 2014, (2 pgs).

(Continued)

*Primary Examiner* — Jonathan M Dager
(74) *Attorney, Agent, or Firm* — Toler Law Group, PC

(57) ABSTRACT

A particular method includes sending a taxiing routing message from a device to a vehicle. The taxiing routing message indicates a route assignment associated with an airport. The method also includes in response to receiving an acknowledgment of the taxiing routing message from the vehicle, indicating a status at a graphical user interface. The status is associated with the taxiing routing message.

22 Claims, 8 Drawing Sheets

(56) References Cited

U.S. PATENT DOCUMENTS 7,477,145 B2 * 1/2009 Tatton ..... G06N 5/025 340/531
7,479,919 B2 * 1/2009 Poe ..... G08G 1/207 342/29
7,499,795 B2 * 3/2009 Fetzmann ..... G08G 5/065 340/958
7,587,278 B2 * 9/2009 Poe ..... G08G 5/0008 340/961
7,860,641 B2 * 12/2010 Meunier ..... G01C 23/00 340/945
8,229,604 B2 * 7/2012 Villaume ..... G08G 1/22 701/10
8,373,579 B2 * 2/2013 Naimer ..... G01C 23/00 340/945
8,457,812 B2 * 6/2013 Zammit-Mangion G08G 5/0065 701/15
8,473,126 B2 * 6/2013 Dunsky ..... G06Q 10/06 340/945
8,527,190 B2 * 9/2013 Mere ..... G08G 5/065 340/958
8,554,457 B2 * 10/2013 White ..... G08G 5/065 701/120
8,606,491 B2 * 12/2013 Subbu ..... G06Q 10/047 340/961
8,700,234 B2 * 4/2014 Shafaat ..... G01C 21/00 701/14
8,903,655 B2 * 12/2014 Feyereisen ..... G01C 23/00 701/3
9,047,770 B2 * 6/2015 Lafon ..... G08G 5/065
9,076,326 B2 * 7/2015 Maji ..... G08G 5/0021
9,092,748 B2 * 7/2015 Greenlaw ..... G08G 5/00
2003/0009278 A1 * 1/2003 Mallet ..... G08G 5/065 701/120
2003/0045994 A1 * 3/2003 Stratton ..... B64F 1/002 701/120
2003/0105579 A1 * 6/2003 Walter ..... G01C 23/005 701/120
2003/0160708 A1 * 8/2003 Knoop ..... G08G 5/0082 340/958
2004/0006412 A1 * 1/2004 Doose ..... G01C 21/26 701/10
2004/0030465 A1 * 2/2004 Conner ..... G01S 19/15 701/16
2005/0090969 A1 * 4/2005 Siok ..... G08G 5/0043 701/120
2005/0190079 A1 * 9/2005 He ..... G01C 23/005 340/945
2005/0283305 A1 * 12/2005 Clark et al. ..... 701/120
2006/0066470 A1 * 3/2006 Anderson ..... B60Q 1/48 342/29
2007/0067093 A1 * 3/2007 Pepitone ..... G01C 23/005 701/120
2007/0078591 A1 * 4/2007 Meunier ..... G05D 1/0083 701/120
2007/0241936 A1 * 10/2007 Arthur ..... G01C 23/00 340/958
2008/0042880 A1 * 2/2008 Ramaiah ..... G01C 21/00 340/958
2008/0109163 A1 * 5/2008 Stone ..... G08G 5/0008 301/16
2008/0306691 A1 * 12/2008 Louis ..... G08G 5/06 701/301
2009/0018713 A1 * 1/2009 Coulmeau ..... G08G 5/0013 701/3
2009/0045982 A1 * 2/2009 Caillaud ..... G08G 5/065 340/972
2009/0051570 A1 * 2/2009 Clark ..... G08G 5/0078 340/971
2009/0118997 A1 * 5/2009 Truitt ..... G08G 5/0026 701/120
2009/0143968 A1 * 6/2009 Truitt ..... G08G 5/0082 701/120
2009/0150013 A1 * 6/2009 Finn ..... G08G 5/065 701/11
2009/0157300 A1 * 6/2009 Clark ..... G08G 5/0039 701/465
2009/0306887 A1 * 12/2009 Clark ..... G01C 23/00 701/533
2010/0017105 A1 * 1/2010 Pepitone ..... G08G 5/0008 701/120
2010/0114922 A1 * 5/2010 Gayraud ..... G08G 5/065 707/758
2010/0125403 A1 * 5/2010 Clark ..... G01C 21/20 701/120
2010/0145605 A1 * 6/2010 Valex ..... G08G 5/065 701/532
2010/0198489 A1 * 8/2010 Rozovski ..... G08G 5/0013 701/120
2010/0204909 A1 * 8/2010 Gayraud ..... G05D 1/0083 701/120
2010/0240988 A1 * 9/2010 Varga ..... G02B 27/017 600/425
2010/0292871 A1 * 11/2010 Schultz ..... G01C 21/00 701/3
2011/0029225 A1 * 2/2011 Stayton ..... G08G 5/065 701/120
2011/0087417 A1 * 4/2011 Anderson ..... B60Q 1/48 701/96
2011/0125399 A1 * 5/2011 Clark ..... G08G 5/0008 701/532
2011/0196598 A1 * 8/2011 Feyereisen ..... G01C 21/00 701/120
2011/0196599 A1 * 8/2011 Feyereisen ..... G01C 21/00 701/120
2011/0199239 A1 * 8/2011 Lutz et al. ..... 340/995.14
2011/0202272 A1 * 8/2011 Feyereisen ..... G01C 23/00 701/532
2011/0313645 A1 * 12/2011 Shukla ..... G08G 5/065 701/120
2012/0253649 A1 * 10/2012 McGuffin ..... G08G 5/065 701/120
2013/0057414 A1 * 3/2013 Nutaro ..... G08G 5/065 340/958
2013/0103297 A1 * 4/2013 Bilek ..... G08G 5/065 701/120
2013/0131888 A1 * 5/2013 Nutaro ..... G08G 5/0021 701/1
2013/0297102 A1 * 11/2013 Hughes ..... G05D 1/0083 701/3
2014/0114557 A1 * 4/2014 Nutaro ..... G01C 21/00 701/121
2014/0278037 A1 * 9/2014 Choksi ..... G08G 5/065 701/120
2015/0154874 A1 * 6/2015 Murthy ..... G08G 5/06 701/120

OTHER PUBLICATIONS

Airport apron, retrieved from the Internet: http://en.wikipedia.org/w/index.php?title=Airport_apron &printab; From Wikipedia, the free encyclopedia; Feb. 20, 2014, (2 pgs).

Flight progress strip, retrieved from the Internet: http://en.wikipedia.org/w/index.php?title=Flight_progress_strip&printabl . . . ; From Wikipedia, the free encyclopedia; Feb. 20, 2014, (2 pgs).

Gros et al., RTCA SC-214/EUROCAE WG-78—Air Traffic Services Safety and Interoperability Requirements, SESAR 6.7.2; Apr. 28, 2011, (7 pgs).

* cited by examiner

SYSTEMS AND METHODS OF AIRPORT TRAFFIC CONTROL

FIELD OF THE DISCLOSURE

The present disclosure is generally related to systems and methods of airport traffic control.

BACKGROUND

Ground-based traffic controllers may direct aircraft and other vehicles at an airport to prevent collisions, to organize and expedite traffic flow, and to provide information to pilots. In a typical airport traffic control system, a traffic controller provides instructions (e.g., a route assignment), via radio communication, to an operator of a vehicle (e.g., a pilot of an aircraft). Such airport traffic control systems can be prone to errors. For example, such airport traffic control systems often rely on manually created records (e-strips) to keep track of instructions provided to various vehicles. Thus, mistakes in data entry can lead to errors. Also, using voice communications can lead to problems. For example, a vehicle operator may not hear an instruction or may misinterpret the instruction. Further, an airport traffic controller may be uncertain as to whether the vehicle operator has received and understood the instructions.

SUMMARY

Systems and methods of airport traffic control are disclosed. In a particular embodiment, route assignments associated with vehicles at an airport may be automatically generated by an airport traffic control system. For example, a route assignment may be generated based on one or more routing rules. Information describing the route assignment may be presented to a traffic controller via a graphical user interface (GUI). The GUI may present the route assignment on a graphical layout of the airport, via text, or both. The traffic controller may initiate digital transmission of the route assignment to a vehicle (e.g., an aircraft) via the GM. An acknowledgment of the route assignment may be received from the vehicle by the airport traffic control system, and the GUI may be updated automatically to indicate a status of the route assignment based on the acknowledgment. For example, the status may indicate whether a pilot of the aircraft accepts or rejects the route assignment.

The disclosed embodiments may enable generation of suggested route assignment modifications, may enable alert generation, or both. For example, an alert and a modification to the route assignment may be displayed via a GUI in response to detecting an aircraft diverting from its route assignment or in response to detecting a conflict between the route assignment and a location or route assignment of another vehicle. The traffic controller may initiate transmission of the modified route assignment to the aircraft and may view a GUI indicating a status of the modified route assignment based on an acknowledgment received from the aircraft.

In a particular embodiment, a method includes sending a taxiing routing message from a device to a vehicle. The taxiing routing message indicates a route assignment associated with an airport. The method also includes in response to receiving an acknowledgment of the taxiing routing message from the vehicle, indicating a status at a graphical user interface. The status is associated with the taxiing routing message.

In another particular embodiment, a system includes a processor and a memory. The memory stores instructions that, when executed by the processor, cause the processor to perform operations includes sending a taxiing routing message to a vehicle. The taxiing routing message indicates a route assignment associated with a vehicle at an airport. The operations also include in response to receiving an acknowledgment of the taxiing routing message from the vehicle, indicating a status at a graphical user interface. The status is associated with the taxiing routing message.

In another particular embodiment, a computer-readable storage device stores instructions, that when executed by a processor, cause the processor to perform operations including sending a taxiing routing message to a vehicle. The taxiing routing message indicates a route assignment associated with a vehicle at an airport. The operations also include in response to receiving an acknowledgment of the taxiing routing message from the vehicle, indicating a status at a graphical user interface. The status is associated with the taxiing routing message.

Thus, particular embodiments facilitate airport traffic control. A traffic controller may view a graphical user interface indicating a status of a route assignment based on an acknowledgment received from a vehicle. If the status indicates that the route assignment is rejected by a pilot, the traffic controller may initiate transmission of a modified route assignment to the vehicle. If the status indicates that the route assignment is accepted by the pilot, the traffic controller may have higher confidence in the pilot following the route assignment. Additionally, a display may be automatically updated to indicate a status of a route assignment (e.g., requested, transmitted, acknowledged, etc.), which reduced manual recordkeeping.

The features, functions, and advantages that have been described can be achieved independently in various embodiments or may be combined in other embodiments, further details of which are disclosed with reference to the following description and drawings.

DETAILED DESCRIPTION

Figure 1:
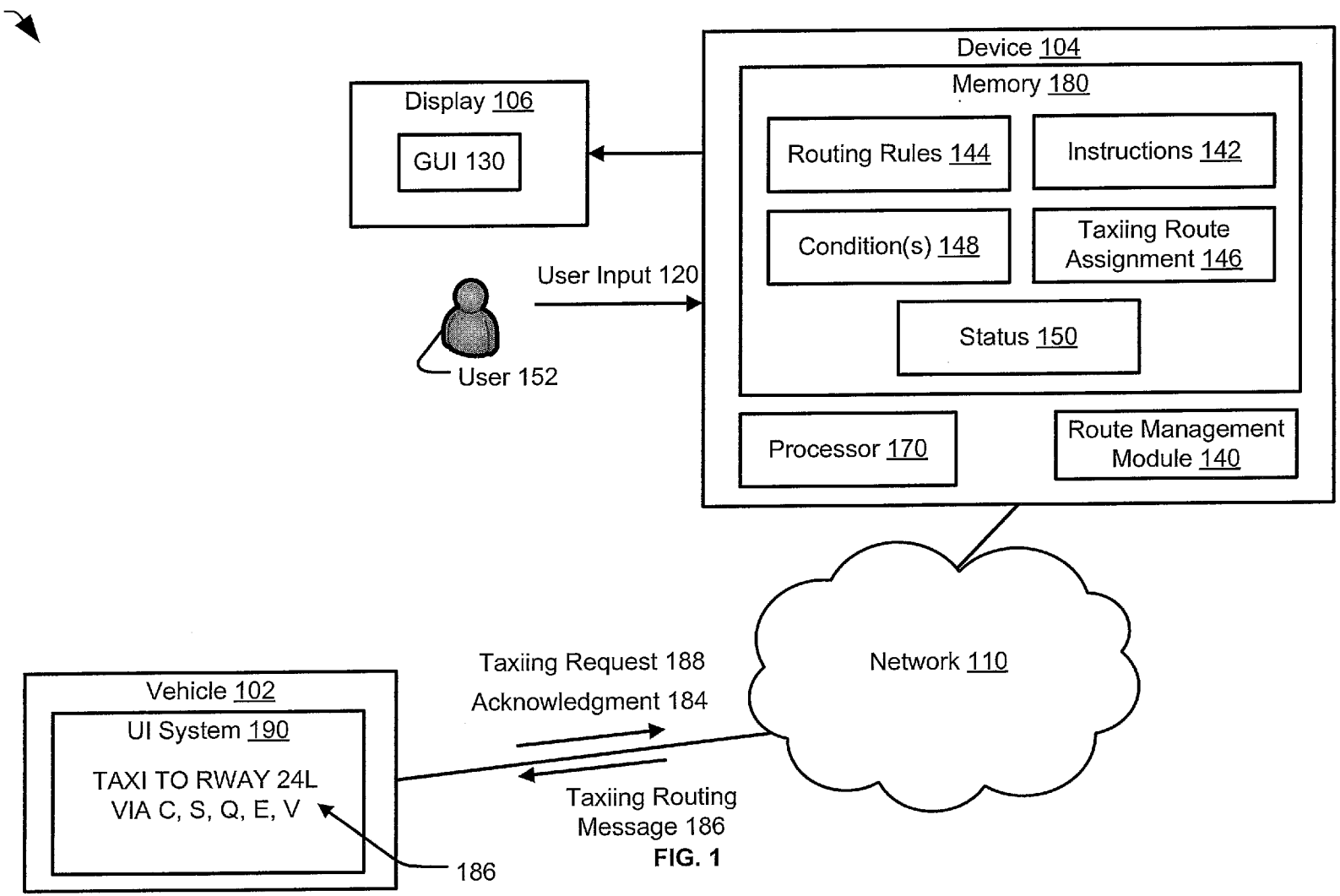
FIG. 1 is a block diagram of a particular embodiment of a system operable to facilitate airport traffic control.

Referring to FIG. 1, a block diagram of a particular embodiment of a system operable to facilitate airport traffic control (e.g., ground control) is disclosed and generally designated 100. The system 100 may include a device 104 that is configured to communicate (e.g., via a network 110) with one or more vehicles (e.g., a vehicle 102) associated with an airport. The vehicle 102 may be an aircraft that is located at or associated with the airport (e.g., parked, taxiing, landing), or is approaching the airport (about the land), or has recently departed the airport. The vehicle 102 may be a ground vehicle associated with the airport. Examples of a ground vehicle may include an aircraft fuel truck, a ground power unit, an air start unit, a potable water truck, a lavatory services vehicle, a catering vehicle, an airport bus, an emergency vehicle, a construction vehicle, a pushback tug, a tractor, a deicing truck, a conveyer belt loader, and a baggage transportation vehicle.

The device 104 may also be coupled to a display 106. In a particular embodiment, the device 104 is a computing device that is configured to facilitate airport traffic control. For example, the device 104 may include a processor 170 and memory 180. The memory 180 may include instructions 142 that are executable by the processor 170 to facilitate assignment, control, display, and communication of taxiing route assignments.

The device 104 may include fewer or more components than illustrated in FIG. 1. For example, the device 104 may include more than one processor 170, may include more than one memory 180, or both. Further, the device 104 is described herein as including rules (such as routing rules 144), data (such as one or more conditions 148, a taxiing route assignment 146, and status 150) and instructions (such as the instructions 142 and a route management module 140), some or all rules, data and instructions may instead be stored at another memory (not shown) that is accessible to the device 104. Further, in some embodiments, the device 104 may include multiple devices of a networked or distributed computing system. In a particular illustrative embodiment, the device 104 may include a computing device, a communications device, a portable computer, a tablet computing device, a personal digital assistant (PDA), a mobile phone, a cellular phone, or a combination thereof. Such devices may include a user interface, e.g., a touch screen, a display, voice recognition capability, or other user interface capabilities.

Additionally, one or more functions described herein as performed by the device 104 may be performed by the processor 170 executing the instructions 142 or executing a particular functional module. Particular functional modules are described separately herein for clarity of description. However, the functional modules of the device 104 may be arranged differently. For example, at least a portion of the route management module 140 may correspond to the instructions 142. To illustrate, a particular function described herein as performed by the route management module 140 may be performed by a processor executing the instructions 142.

During operation, the device 104 may receive the one or more conditions 148. The conditions 148 may provide information about a particular vehicle (e.g., the vehicle 102) associated with the airport. For example, the conditions 148 may indicate locations of a plurality of vehicles within a particular distance (e.g., within a 30 to 50 nautical mile radius) of an airport and the plurality of vehicles may include the particular vehicle (e.g., the vehicle 102). The location of a particular vehicle (e.g., the vehicle 102) may include information such as an altitude, a latitude, a longitude, other similar coordinate descriptions (such as azimuth and elevation), or a combination thereof. The conditions 148 may also include information regarding a current or future (e.g., planned or intended) direction of travel of the particular vehicle (e.g., the vehicle 102). For example, conditions 148 may indicate a heading, a pitch, a yaw, a destination (e.g., a runway, a terminal, or a gate destination) or a combination thereof, of the particular vehicle (e.g., the vehicle 102). The conditions 148 may further indicate a speed of the particular vehicle (e.g., the vehicle 102), a type or size of the particular vehicle (e.g., the vehicle 102), an identifier of the particular vehicle (e.g., the vehicle 102), or other information that is used to generate or track a taxiing route assignment (e.g., the taxiing route assignment 146).

The memory 180 may store taxiing route assignments (e.g., the taxiing route assignment 146) of one or more of the plurality of vehicles (e.g., the vehicle 102). For example, the taxiing route assignment 146 may identify one or more waypoints of a taxiing route, a gate assignment, a runway assignment (or other destination assignment), a particular taxiway or other path to be traversed, or a combination thereof. A waypoint may be a particular geographical location (e.g., defined in terms of coordinates), a named point (e.g., defined in terms of a name assigned to a particular geographic location), or other information. For example, a particular waypoint at John F. Kennedy International Airport in New York may be identified by a particular name (e.g., "WAVEY"), by particular coordinates (longitude 40 degrees 14.08 minutes and latitude 73 degrees 23.66 minutes), or both. In a particular embodiment, the taxiing route assignment 146 also defines a particular direction of travel, a particular speed, or other information.

The status 150 may include information associated with a status of the taxiing route assignment 146. For example, the status 150 may indicate whether the taxiing route assignment 146 has been communicated to the vehicle 102 (e.g., via a taxiing routing message 186), whether an acknowledgment 184 of the taxiing route assignment 146 has been received from the vehicle 102, whether the vehicle 102 is complying with the taxiing route assignment 146, a history of communications between the device 104 and the vehicle 102 related to taxiing route assignments (e.g., the taxiing route assignment 146), requests (e.g., a taxiing request 188), acknowledgments (e.g., the acknowledgment 184), or a combination thereof.

The route management module 140 may prepare and send routing messages (e.g., the taxiing routing message 186) to a plurality of vehicles associated with the airport. For example, the route management module 140 may prepare and send the taxiing routing message 186 to the vehicle 102. The taxiing routing message 186 may be a text-based data communication (as opposed to a voice communication). Using text-based communications to convey the taxiing routing message 186 may reduce a likelihood of the taxiing routing message 186 being misunderstood. An example of text of the taxiing routing message 186 is illustrated in text box 222 of FIG. 2. To illustrate, the text of the taxiing routing message 186 may include "TAXI TO RWY 24L VIA C, S, Q, E, V". The taxiing routing message 186 may indicate the taxiing route assignment 146. For example, the taxiing route assignment 146 may include one or more waypoints (e.g., the waypoints C, S, Q, E, and V) and a particular runway (e.g., the runway 24L). In response to receiving the taxiing routing message 186, the vehicle 102 (or an operator of the vehicle 102, such as a pilot) may accept the taxiing route assignment 146 and affirm receipt of the taxiing routing message 186 by transmitting the acknowledgement 184. For example, the vehicle 102 may have a user interface system 190 (e.g., a datalink control and display unit (DCDU)) that displays the text of the taxiing routing message 186. The operator of the vehicle 102 may provide a first input indicating acceptance of the taxiing route assignment 146. In response to receiving the first input, the user interface system 190 may generate and transmit the acknowledgement 184 to the device 104.

If the taxiing routing message 186 is not accepted, the vehicle 102 (or the operator of the vehicle 102) may instead send the taxiing request 188. The taxiing request 188 may request a modification of the taxiing route assignment 146. For example, the operator of the vehicle 102 may provide a second input indicating that the taxiing route assignment 146 is rejected. The user interface system 190 may, in response to receiving the second input, generate the taxiing request 188 indicating that the taxiing route assignment 146 is to be modified.

In a particular embodiment, the route management module 140 uses the conditions 148, the routing rules 144, the status 150, taxiing route assignments of other vehicles, or a combination thereof, to automatically propose a taxiing route assignment (e.g., the taxiing route assignment 146) for a particular vehicle (e.g., the vehicle 102) associated with the airport, as described with reference to FIG. 2. A proposed taxiing route assignment (e.g., the taxiing route assignment 146) generated by the route management module 140 may be presented to a user 152 (e.g., a traffic controller) via a graphical user interface (GUI) 130 for confirmation. In a particular embodiment, the GUI 130 may include an electronic flight strip system (e-strip) display portion and a graphical layout portion of the airport, as described with reference to FIG. 2. The route management module 140 may indicate the taxiing route assignment 146 on the graphical layout portion of the GUI 130.

The GUI 130 may be presented on the display 106. If the route management module 140 receives a user input 120 indicating that the user 152 (e.g., the traffic controller) accepts (or authorizes) the taxiing route assignment 146, the route management module 140 may send the taxiing routing message 186 to the vehicle 102. The taxiing routing message 186 may indicate the taxiing route assignment 146. In a particular embodiment, the route management module 140 may assign the taxiing route assignment 146 to the vehicle 102 in response to generating the proposed taxiing route assignment 146, in response to determining that the user input 120 indicates that the user 152 accepts (or authorizes) the taxiing route assignment 146, or in response to receiving the acknowledgment 184.

In a particular embodiment, the route management module 140 may also indicate other data at the GUI 130. In a particular embodiment, the route management module 140 may indicate the taxiing route assignment 146 and/or the other data on the e-strip display portion of the GUI 130, the graphical layout portion of the GUI 130, or both, as described with reference to FIG. 2. For example, the e-strip display portion may include a textual representation of the other data and the graphical layout portion may include a graphical representation of the other data. The GUI 130 may thus combine functionality of e-strip systems with graphical layout displays.

The other data may be related to taxiing route assignments (e.g., the taxiing route assignment 146). For example, the GUI 130 may indicate the status 150 associated with the taxiing routing message 186 (e.g., whether the taxiing routing message 186 has been sent, whether the acknowledgment 184 corresponding to the taxiing routing message 186 has been received, etc.).

As another example, the GUI 130 may indicate an alert associated with the taxiing routing message 186. In a particular embodiment, the GUI 130 may indicate that two or more taxiing route assignments conflict, as described with reference to FIG. 4. For example, the GUI 130 may indicate a conflict between the taxiing route assignment 146 and another taxiing route assignment corresponding to another vehicle.

In a particular embodiment, the GUI 130 may indicate that the vehicle 102 has deviated from the taxiing route assignment 146, as described with reference to FIG. 6. For example, a last received location of the vehicle 102 may differ from an expected location of the vehicle 102. The expected location of the vehicle 102 may be based on the taxiing route assignment 146. The last received location of the vehicle 102 may be received from the vehicle 102, from a sensor at the airport, or both. In a particular embodiment, the GUI 130 may indicate one or more taxiing route assignments (e.g., the taxiing route assignment 146) on a graphical layout of the airport (as shown in FIG. 2).

In a particular embodiment, the GUI 130 may indicate a proposed routing assignment (e.g., the taxiing route assignment 146 determined based on the routing rules 144). The taxiing route assignment 146 may be identified using text (e.g., text of a proposed taxiing routing message 186), may be displayed graphically on a graphical layout of the airport, or both. In this embodiment, the user 152 (e.g., the traffic controller) may interact with the GUI 130 by providing the user input 120 to modify the taxiing route assignment 146, as described with reference to FIGS. 4-5. The taxiing routing message 186 sent to the vehicle 102 may indicate the modified taxiing route assignment 146.

For example, the user 152 (e.g., the traffic controller) may provide the user input 120 to modify the taxiing route assignment 146 such that way points corresponding to a less busy portion of the airport are included. As another example, the user 152 (e.g., the traffic controller) may be aware of a particular situation (e.g., a passenger with a medical emergency, an overheated engine, a security situation, etc.) that is not included in the conditions 148, that is not addressed by the routing rules 144, or both. In this example, the user 152 may provide the user input 120 to modify the taxiing route assignment 146 such that the vehicle 102 is directed to a particular location (e.g., a waypoint or a gate) where ground personnel (e.g., doctors) are available to address the particular situation (e.g., the medical emergency).

In a particular embodiment, the user input 120 may include modifications to text of the taxiing routing message 186. In response to receiving the modifications to the text of the taxiing routing message 186, the route management module 140 may update a graphical representation of the taxiing route assignment 146 on a graphical layout of the airport, as described with reference to FIG. 4. As another example, the user input 120 may correspond to a user selection of one or more graphical elements of the graphical layout of the airport, as described with reference to FIG. 5. The graphical elements may represent the proposed taxiing route assignment 146. To illustrate, the user 152 may select a line representing the proposed taxiing route assignment 146 and may drag and drop the line to another location (corresponding to a modified taxiing route assignment 146). As another illustration, the user 152 may select a point in the graphical layout to designate a location corresponding to the point as a waypoint of the taxiing route assignment 146. The route management module 140 may modify the taxiing route assignment 146 in response to receiving the user input 120, as described with reference to FIGS. 4-5.

In a particular embodiment, the routing rules 144 may indicate that the user 152 controls vehicles that are at, have been at, and/or are headed towards a particular location. The route management module 140 may determine that the user 152 is in control of the vehicle 102 in response to determining that the conditions 148 indicate that the vehicle 102 is at, has been at, and/or is headed towards the particular location. The route management module 140 may indicate on the graphical user interface 130 that the user 152 is in control of the vehicle 102, as described with reference to data element 232 of FIG. 2.

In a particular embodiment, the route management module 140 may automatically hand off control to another user in response to determining that the conditions 148 indicate that the vehicle 102 is at, has been at, and/or is headed towards a second location and that the routing rules 144 indicate that the other user controls vehicles that are at, have been at, and/or are headed towards the second location. For example, the route management module 140 may update the graphical user interface 130 to indicate that the other user controls the vehicle 102 in response to determining that the vehicle 102 is headed towards the second location and that the routing rules 144 indicate that the other user controls vehicles headed towards the second location.

In a particular embodiment, the route management module 140 of the device 104 may send a message to the route management module 140 of another device to indicate that the other user controls the vehicle 102. The other device may be associated with the other user. In a particular embodiment, the route management module 140 of the device 104 may send the taxiing route assignment 146 to another device. For example, the other device may display a status (e.g., an arrival gate) of the vehicle 102 based on the taxiing route assignment 146.

During operation, the system 100 may enable the user 152 to control and maintain awareness of many aspects related to airport ground traffic. The system 100 may simplify and automate some aspects of generating a taxiing route assignment while still enabling the user 152 to authorize each taxiing route assignment. Additionally, the system 100 may interact with one or more other systems (not shown) such as other devices 104 that are used to control ground traffic, devices (not shown) that are used to control air traffic, devices that are used for airline or passenger information (e.g., status displays), and so forth. The system 100 may also automatically hand off control of a particular vehicle from one user to another user (e.g., from the user 152 to another user (not shown)) to clarify who is controlling each vehicle associated with the airport. The system 100 may further enable automatic collection and storage of records of communications between controllers and vehicles. Additionally, by combining functionality of e-strip systems (such as are used to facilitate ground control at certain airports) with graphical airport displays, the system 100 may assist controllers with understanding routing decisions and options more quickly, which may reduce airport congestion and improve safety.

Figure 2:
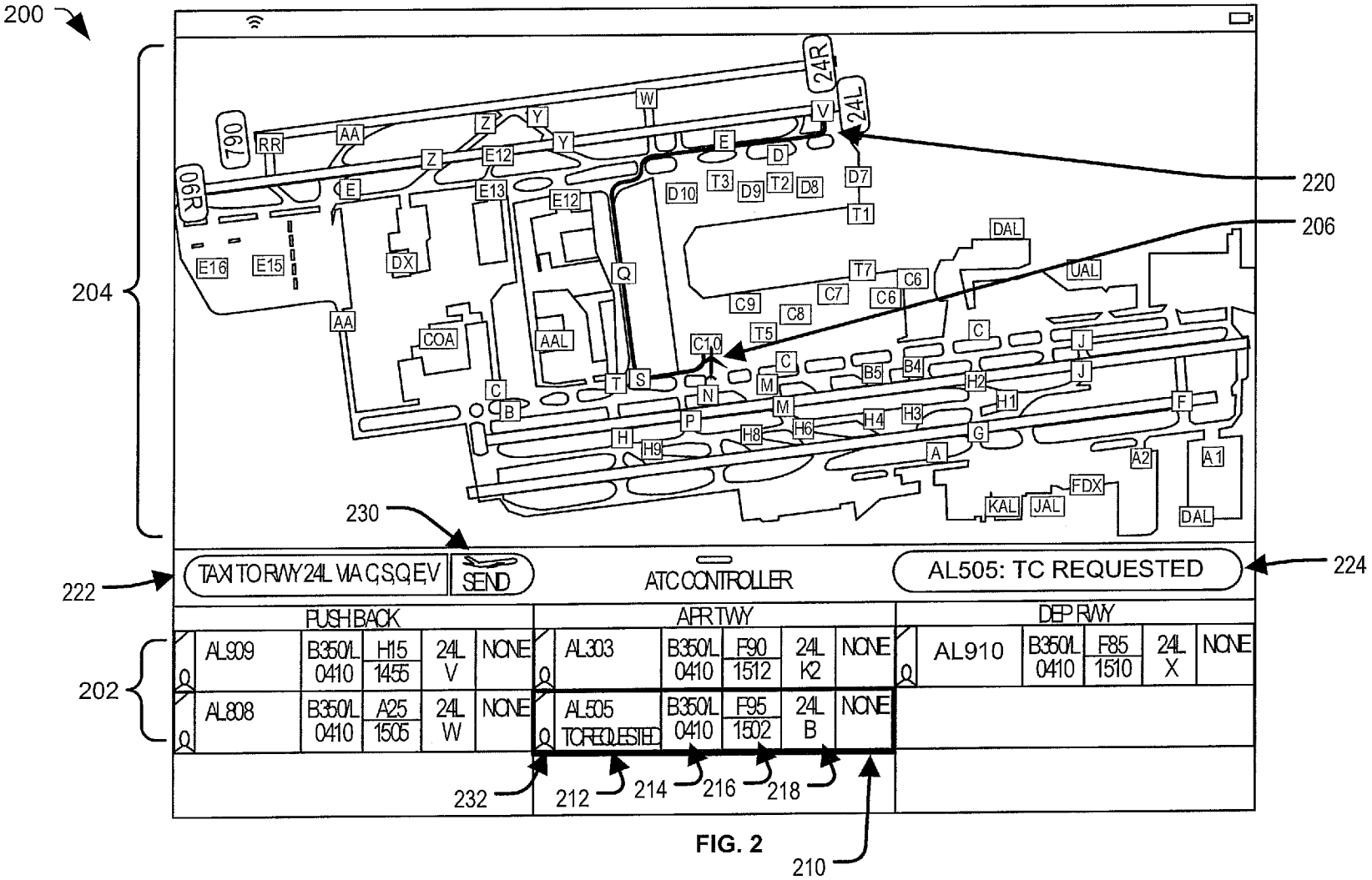
FIG. 2 is a diagram of a particular embodiment of a graphical user interface that may be generated by the system of FIG. 1.

Referring to FIG. 2, a particular embodiment of a graphical user interface (GUI) is shown and generally designated 200. In a particular embodiment, the GUI 200 may be generated by the route management module 140, may be stored in the memory 180, and may be displayed at the display 106 of FIG. 1. In a particular embodiment, the GUI 200 may correspond to the GUI 130 of FIG. 1.

The GUI 200 may facilitate airport traffic control. In particular embodiment, the GUI 200 provides an electronic flight strip system (e-strip) display portion 202 and a graphical layout portion 204 of the airport. The e-strip display portion 202 may include information regarding aircraft and other vehicles, such as ground vehicles, within an airport environment. Examples of a ground vehicle may include an aircraft fuel truck, a ground power unit, an air start unit, a potable water truck, a lavatory services vehicle, a catering vehicle, an airport bus, an emergency vehicle, a construction vehicle, a pushback tug, a tractor, a deicing truck, a conveyer belt loader, and a baggage transportation vehicle.

In a particular embodiment, the e-strip display portion 202 may include information (e.g., textual information, visual information, or both) regarding the vehicle 102 of FIG. 1. The graphical layout portion 204 may include a pictorial representation of the airport and may illustrate graphically one or more vehicles (e.g., the vehicle 102) present at the airport, such as an aircraft 206. In a particular embodiment, the aircraft 206 may be the vehicle 102.

In a particular embodiment, a user (e.g., the user 152 of FIG. 1) controlling airport traffic may select or indicate a particular aircraft (e.g., the aircraft 206) to be controlled by selecting or highlighting an e-strip 210 within the e-strip display portion 202. In the specific example illustrated in FIG. 2, the e-strip 210 is highlighted using a solid border to indicate that an aircraft (e.g., the aircraft 206) designated AL505 is being controlled. In a particular embodiment, an e-strip (e.g., the e-strip 210) may be highlighted using a particular font (e.g., Arial, Times New Roman, etc.), a particular font style (e.g., bold, italic, underlined, etc.), a particular font size (e.g., 10, 12, 14, etc.), a particular color (e.g., font color, highlighting color, background color, etc.), a particular border (e.g., solid lines, broken lines, etc.), or a combination thereof.

The e-strip display portion 202 may include one or more e-strips associated with other aircraft. For example, as illustrated in FIG. 2, the e-strip display portion 202 includes e-strips corresponding to an aircraft designated AL909, an aircraft designated AL808, an aircraft designated AL303, and an aircraft designated AL910.

Each e-strip of the e-strip display portion 202 may include a textual or graphical representation that indicates a particular user in control of a corresponding vehicle, an identifier of the vehicle, and a status of the vehicle. For example, data element 232 may include a graphical representation that indicates that the user 152 is in control of a vehicle (e.g., the aircraft 206) corresponding to the e-strip 210. Descriptor 212 may indicate an identifier (e.g., AL505) of the aircraft 206 and may indicate a status (e.g., the status 150, such as taxiing clearance (TC) requested) of the aircraft 206.

Each e-strip may also include a descriptor (e.g., a model or type identifier) of a corresponding vehicle, a location (e.g., a starting location, a previously received location, or both) of the vehicle, a destination or assigned location of the vehicle, or a combination thereof. For example, the data element 214 may include a descriptor (e.g., B350L 0410) of the vehicle (e.g., the aircraft 206) corresponding to the e-strip 210, the data element 216 may include a previously received location (e.g., F95 1502) of the aircraft 206, and the data element 218 may include an assigned location (e.g., 24L B) of the aircraft 206.

To illustrate, in the particular illustration represented in FIG. 2, the aircraft identified as AL505 and corresponding to the aircraft 206 has been selected by the user 152 as indicated by a highlight box around the e-strip 210. The aircraft AL505 has requested taxiing clearance and an airport traffic control system (e.g., the system 100, the route management module 140 of FIG. 1, or both) has automatically generated a proposed taxiing route (e.g., the taxiing route assignment 146 of FIG. 1).

For example, the conditions 148 of FIG. 1 may indicate that the aircraft 206 is proximate to a first location (e.g., a waypoint, such as a gate C10) and has a particular destination (e.g., a runway 24L). The routing rules 144 may indicate paths between various locations of the airport and a preference metric (e.g., a distance) associated with each path. For example, the routing rules 144 may indicate a first path (e.g., via waypoints C, S, Q, E, and V) from the first location (e.g., the gate C10) to the particular destination (e.g., the runway 24L) has a shortest distance of a plurality of paths from the first location to the particular destination.

In a particular embodiment, the routing rules 144 may indicate that a waypoint having a first property is to be included in a proposed taxiing route if the vehicle under control (e.g., the aircraft 206) has a second property. The conditions 148 may indicate a set of waypoints that have the first property and may indicate that the aircraft 206 has the second property. The route management module 140 may automatically include a first waypoint of the set of waypoints in the taxiing route assignment 146. For example, the route management module 140 may identify the set of way points based on determining that the aircraft 206 has the second property, that each of the set of waypoints has the first property, and that the routing rules 144 indicates that a particular waypoint having the first property is to be included in the proposed taxiing route. The route management module 140 may select the first waypoint from the set of waypoints based on a preference metric associated with each of the set of waypoints. For example, the routing rules 144 may indicate that an aircraft associated with an international flight is to be assigned a gate in an immigration area of the airport. The conditions 148 may indicate that the aircraft 206 is associated with an international flight and that a set of gates are in the immigration area of the airport. The route management module 140 may select a particular path that includes the particular gate based on a preference metric (e.g., distance) of the particular path.

The conditions 148 may indicate any paths (or portions of paths) that are inaccessible. For example, the conditions 148 may indicate that a path is marked as inaccessible by a particular user for various reasons, such as for repair and maintenance, another vehicle located in the path, etc., or that a path is inaccessible based on a type of a particular vehicle that is being controlled (e.g., particular locations may be inaccessible due to a wingspan of a particular type of aircraft). The route management module 140 may automatically identify, based on the routing rules 144 and the conditions 148, a particular path that is accessible and has a highest (or lowest) preference metric of the accessible paths from the first location to the particular destination. In a particular embodiment, the route management module 140 may automatically identify, based on the routing rules 144 and the conditions 148, a particular path that is accessible, that includes a waypoint having a particular property, and that has a highest (or lowest) preference metric of the accessible paths from the first location that include a waypoint having the particular property. The route management module 140 may select the identified path as the proposed taxiing route (e.g., the taxiing route assignment 146 of FIG. 1).

In a particular embodiment, the route management module 140 may determine whether another taxiing route assignment associated with another vehicle includes the identified path (or a portion of the identified path). In a particular embodiment, the route management module 140 may automatically identify, based on the routing rules 144 and the conditions 148, an alternate path that excludes the waypoints included in the other taxiing route assignment. In an alternate embodiment, the route management module 140 may modify the proposed taxiing route to indicate that the aircraft 206 is to take a particular action (e.g., wait for permission, wait for a particular time duration (e.g., 10 minutes), or both) prior to proceeding to an overlapping portion of the identified path and the other taxiing route assignment. For example, the overlapping portion may begin at a particular waypoint (e.g., the waypoint E). The route management module 140 may add a particular indicator (e.g., "!", "10 minute wait", etc.) to the proposed taxiing route (e.g., via waypoints C, S, Q, E!, and V). For example, the route management module 140 may indicate the particular indicator in the text (e.g., "TAXI TO RWY 24L VIA C, S, Q, E!, V") of the textbox 222. Text (e.g., "TAXI TO RWY 24L VIA C, S, Q, E!, V") of the taxiing routing message 186 may include the particular indicator. The particular indicator may alert an operator (e.g., a pilot) of the aircraft 206 that the particular action is to be taken at the particular waypoint.

The GUI 200 may include a textual representation, a graphical representation, or both, of the proposed taxiing route (e.g., the taxiing route assignment 146). For example, the proposed taxiing route (e.g., the taxiing route assignment 146) is illustrated in the graphical layout portion 204 at 220, and a text description of the proposed taxiing route (e.g., the taxiing route assignment 146) is illustrated at a text box 222. Further, the vehicle under control (i.e., the selected aircraft 206 (AL505)), is identified at data element 224.

In a particular embodiment, the data element 224 may also indicate the status 150 (e.g., TC REQUESTED) of the aircraft 206. In a particular embodiment, the taxiing route assignment 146 may include a gate assignment of the aircraft 206. In this embodiment, the GUI 200 may indicate the gate assignment corresponding to the aircraft 206. In a particular embodiment, the route management module 140 may display additional information (e.g., a communication history) regarding the aircraft 206 in response to receiving a selection of the data element 224, the e-strip 210, or the graphical representation of the aircraft 206. For example, the user 152 may use an input device (e.g., a mouse) to select (e.g., click) on the data element 224. In response to receiving the selection of the data element 224, the route management module 140 may display a pop-up window on the GUI 200. The pop-window may indicate some or all messages exchanged with the aircraft 206 within a particular time period (e.g., within a previous day, within an hour, etc.). In a particular embodiment, the route management module 140 may display messages exchanged between the aircraft 206 and all or a subset of traffic controllers at the airport. For example, the route management module 140 may display messages exchanged between the aircraft 206 and the user 152.

If an airport traffic controller (e.g., the user 152) accepts the proposed routing assignment (e.g., the taxiing route assignment 146) indicated at 220 and at the text box 222, the user 152 may select a selectable input 230 to transmit a text description of the taxiing route assignment 146 to the aircraft 206. For example, the route management module 140 may, in response to receiving the selection of the selectable input 230, send a text message including the text description of the taxiing route assignment 146 to the UI system 190 of FIG. 1. The text message may correspond to the taxiing routing message 186 of FIG. 1.

The airport traffic controller (e.g., the user 152) may identify the aircraft 206 based on the selected text description within the e-strip 210, based on the text identifier (e.g., AL505) of the aircraft 206 at the data element 224, by highlighting or selecting the aircraft (e.g., the aircraft 206) in the graphical layout portion 204, or a combination thereof. Additionally, the user 152 may observe the taxiing route assignment 146 as a textual representation in the text box 222, as a graphical representation overlaid on the graphical layout portion 204, or both.

The GUI 200 may enable the user 152 to observe both textual and graphical representations of the taxiing route assignment 146 and the aircraft 206 (or other vehicles at the airport) under control. The ability to observe both textual and graphical representations may expedite providing taxiing route assignments (e.g., the taxiing route assignment 146) by the user 152 to each vehicle (e.g., the aircraft 206) and may reduce opportunities for errors by the user 152. For example, opportunities for user error may be reduced because the airport traffic control system (e.g., the route management module 140 of FIG. 1) automatically generates a textual representation corresponding to a proposed routing assignment (e.g., the taxiing route assignment 146) and a graphical representation of the route assignment. In a particular embodiment, the e-strip display portion 202 may also include other information, such as color coding that indicates alerts as described herein, a location or control point associated with the aircraft 206 such as a push back location, an apron departure runway location (e.g., 24L B) corresponding to a data element 218, or a combination thereof.

Additionally, as control of a particular aircraft (e.g., the aircraft 206) passes from one user (e.g., the user 152) to another user or from one controller to another controller, e-strips (e.g., the e-strip 210) may be relocated within the e-strip display portion 202, color coding and/or information within the e-strips may change, or a combination thereof. For example, when control of the aircraft 206 transitions to a different controller, the e-strip display portion 202 may be updated by removing the record associated with the aircraft 206 from the GUI 130. In this example, the record associated with the aircraft 206 may be displayed at another GUI. The other GUI may be presented at a display associated with the different controller. In a particular embodiment, when control of the aircraft 206 transitions to the different controller, the route management module 140 of FIG. 1 may move the record to a different location within the e-strip display portion 202 (e.g., to the left column rather than the center column) of the GUI 130.

Further, as a status (e.g., the status 150) of a particular aircraft (e.g., the aircraft 206) changes, the e-strip display portion 202, the graphical layout portion 204, or both may be updated to reflect the status change. For example, as illustrated in FIG. 2, a status (e.g., the status 150 of FIG. 1) of the taxiing route assignment 146 corresponding to taxiing clearance (TC) requested is indicated at the descriptor 212. The status 150 is associated with the selected aircraft 206. In response to transmission of the taxiing routing message 186 of FIG. 1, the status 150 may be updated in the descriptor 212 to indicate transmission of the taxiing routing message 186, assignment of the taxiing route assignment 146, or both. The taxiing routing message 186 may include the text description of the taxiing route assignment 146 shown in the text box 222. Other status messages may also be indicated in the GUI 200, such as receipt of the acknowledgment 184 of FIG. 1 in response to sending the taxiing routing message 186, a taxiing route assignment alert, other conditions, or a combination thereof, as described herein.

Figure 3:
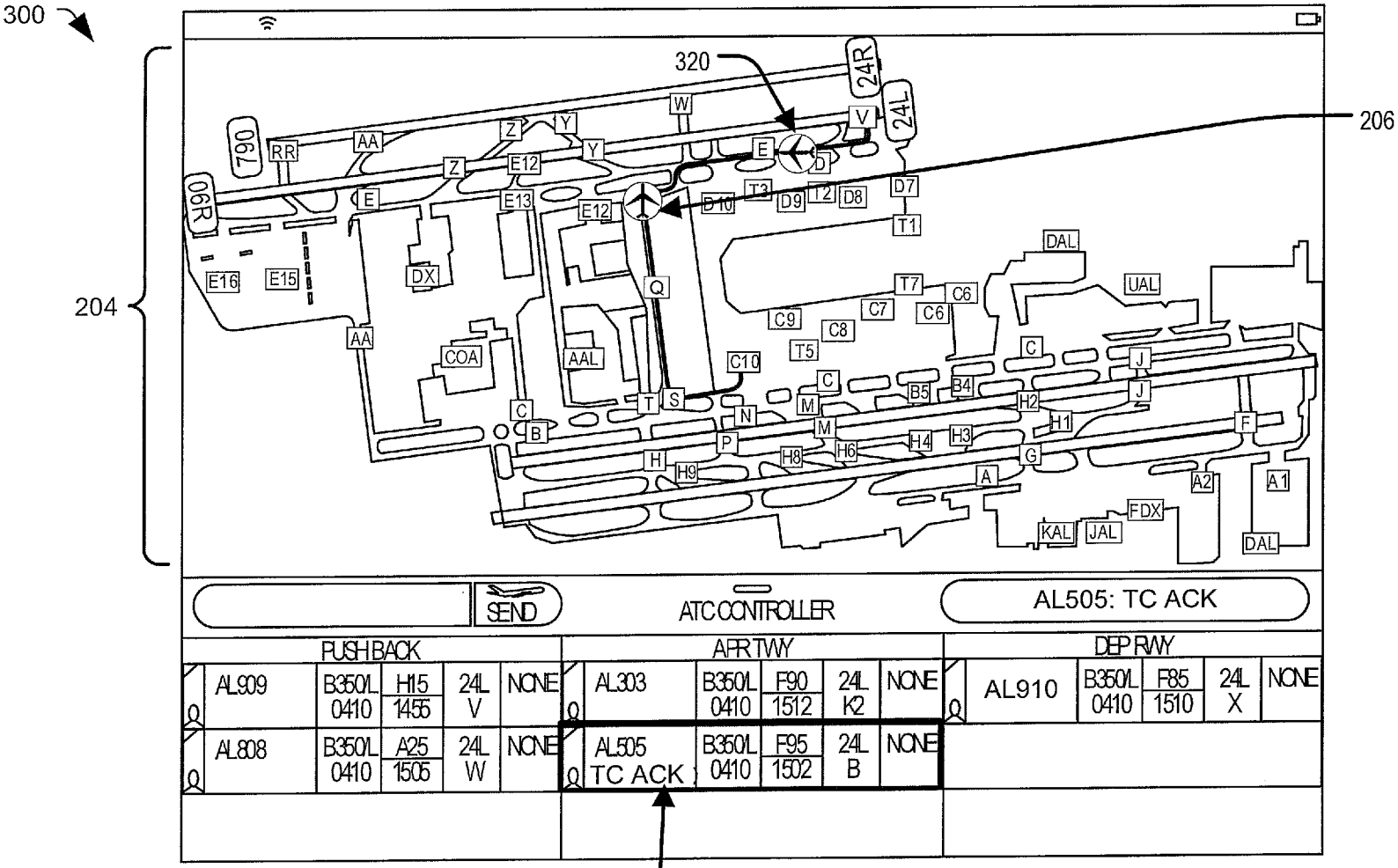
FIG. 3 is a diagram of another particular embodiment of a graphical user interface that may be generated by the system of FIG. 1.

Referring to FIG. 3, a particular embodiment of a graphical user interface (GUI) is shown and generally designated 300. In a particular embodiment, the GUI 300 may be generated by the route management module 140 of FIG. 1. In a particular embodiment, the GUI 300 may correspond to the GUI 130 of FIG. 1.

In FIG. 3, the proposed taxiing route assignment (e.g., the taxiing route assignment 146) illustrated in FIG. 2 has been communicated to the aircraft 206. For example, the route management module 140 of FIG. 1 may have transmitted the taxiing route message 186 to the vehicle 102 (e.g., the aircraft 206). The taxiing route message 186 may indicate the text shown at the text box 222 of FIG. 2. Additionally, the aircraft 206 has acknowledged receipt of the taxiing route assignment 146 as indicated by the descriptor 212 indicating taxiing clearance (TC) acknowledgment (ACK). For example, the vehicle 102 may have sent the acknowledgment 184 to the device 104 in response to receiving the taxiing route message 186. The route management module 140 may generate the GUI 300 including the descriptor 212 indicating the status 150 in response to receiving the acknowledgment 184. The status 150 may have a first status value (e.g., TC ACK) indicating that the taxiing route assignment 146 is accepted.

In a particular embodiment, the route management module 140 may generate the GUI 300 including the descriptor 212 indicating the status 150 in response to response to receiving the taxiing request 188 of FIG. 1. For example, the vehicle 102 may have sent the taxiing request 188 of FIG. 1 in response to receiving the taxiing route message 186. The taxiing request 188 may indicate that a pilot or other operator of the vehicle 102 rejected the taxiing route assignment 146 indicated by the taxiing route message 186. The status 150 may have a second status value (e.g., TC rejected (REJ) or TC requested) based on receiving the taxiing request 188 that indicates that the taxiing route assignment 146 is rejected.

In response to receiving the taxiing request 188 or in response to determining that the taxiing route assignment 146 is rejected, the route management module 140 may automatically determine another (or updated) taxiing route assignment (e.g., the taxiing route assignment 146), as described herein. In a particular embodiment, the route management module 140 may identify a subsequent taxiing route assignment that is distinct from a taxiing route assignment that was previously rejected by the aircraft 206. For example, a location of the aircraft 206 may have changed and the updated taxiing route assignment 146 may correspond to the changed location. As another example, the updated taxiing route assignment 146 may correspond to an alternate path between the location of the aircraft 206 and a particular destination of the aircraft 206.

The route management module 140 may generate (or update) the GUI 200 to indicate the updated taxiing route assignment 146. In response to receiving a selection of the selectable input 230, the route management module 140 may send the taxiing routing message 186 to the vehicle 102. The taxiing routing message 186 may indicate the updated taxiing route assignment 146.

Additionally as information about the aircraft 206 is received during taxiing, the route management module 140 may update the graphical layout portion 204 to indicate a current location, an estimated location, or last known location of the aircraft 206 within the airport. Thus, the aircraft 206 may be shown in the GUI 300 as traversing the assigned taxiing routing (e.g., the taxiing route assignment 146). Additionally, other vehicles (such as an aircraft 320) may be shown in the graphical layout portion 204. For example, the route management module 140 may update the GUI 300 to show the other aircraft 320 when a location of the other aircraft 320 is relevant to a location or taxiing route assignment (e.g., the taxiing route assignment 146) of the aircraft 206. To illustrate, the route management module 140 may indicate the other aircraft 320 on the GUI 300 in response to determining that a first portion of the taxiing route assignment 146 is within a particular distance of a second portion of a taxiing route assignment corresponding to the other aircraft 320. In another example, all other aircraft or a subset of other aircraft or a subset of vehicles associated with the airport may be represented on the graphical layout portion 204.

The route management module 140 may determine a location of an aircraft (e.g., the aircraft 206, the aircraft 320, or both) based on the conditions 148 of FIG. 1 or status information (e.g., the status 150 of FIG. 1) received from airport or aircraft systems, such as radar returns, GPS coordinate transmission, visual information input by a user, voice or text communications from the aircraft (e.g., the acknowledgment 184, the taxiing request 188 of FIG. 1, or both) or any other information gathered by airport systems to indicate a current location or a last known location of the aircraft (e.g., the aircraft 206, the aircraft 320, or both). Accordingly, the GUI 300 may enable the user 152 of FIG. 1, such as an airport traffic controller, to identify a current status or a last known status (e.g., the status 150) of ground vehicles (e.g., the vehicle 102) and aircraft (e.g., the vehicle 102, the aircraft 206 and/or the aircraft 320) at the airport to identify potential hazards, deviations from assigned routing (e.g., the taxiing route assignment 146), interference between routing assignments and so forth, as described herein.

Figure 4:
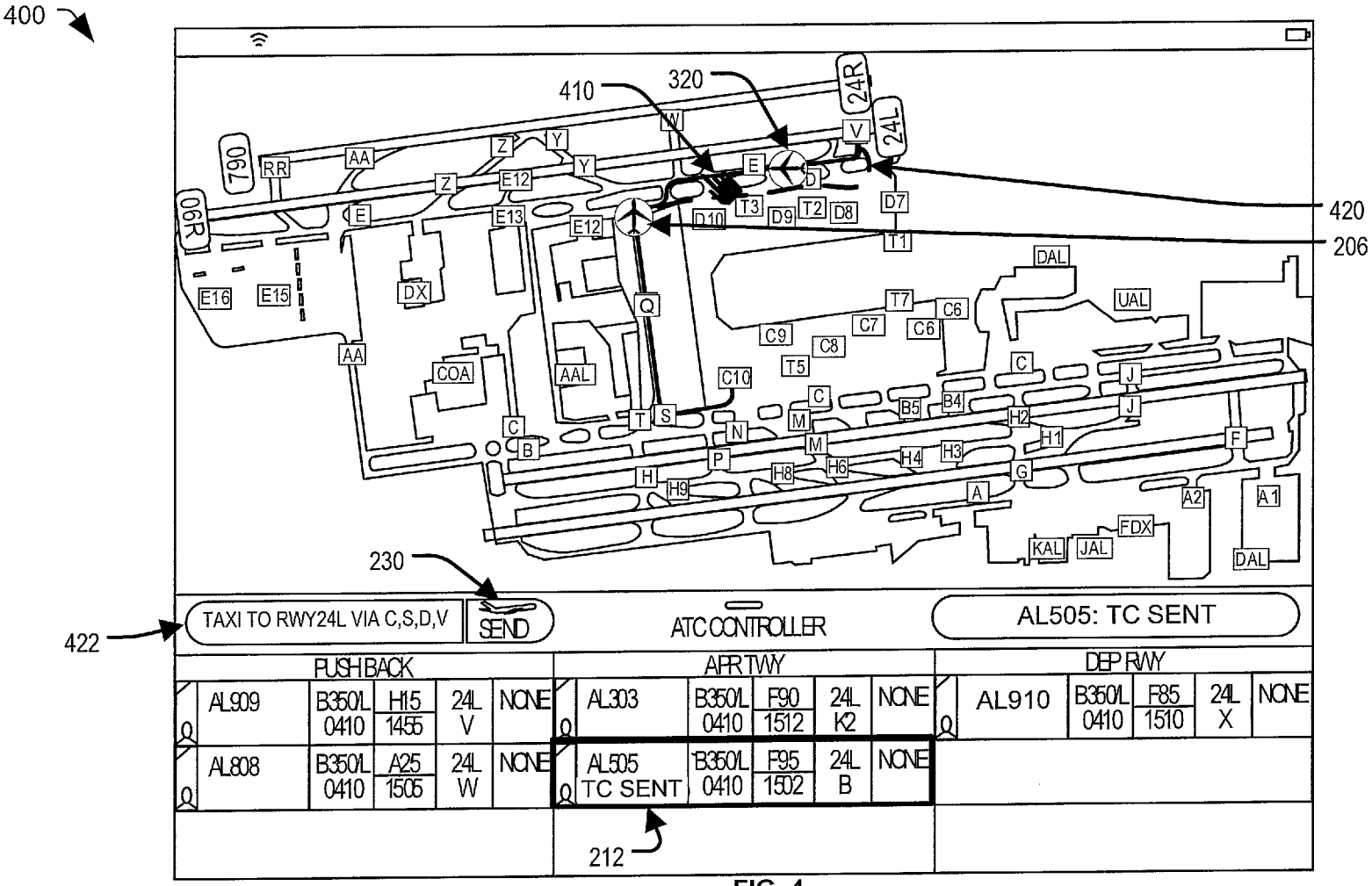
FIG. 4 is a diagram of another particular embodiment of a graphical user interface that may be generated by the system of FIG. 1.

Referring to FIG. 4, a particular embodiment of a graphical user interface (GUI) is shown and generally designated 400. In a particular embodiment, the GUI 400 may be generated by the route management module 140 of FIG. 1. In a particular embodiment, the GUI 400 may correspond to the GUI 130 of FIG. 1.

The GUI 400 may illustrate modification of an assigned routing (e.g., the taxiing route assignment 146 of FIG. 1). In the example illustrated in FIG. 4, the user 152 is utilizing a drag and drop operation to modify the taxiing route assignment 146. For example, the user 152 may select one or more graphical elements of a graphical layout of an airport to modify the taxiing route assignment 146.

The GUI 400 may indicate an assigned taxiing route (e.g., the taxiing route assignment 146) using a first indicator (e.g., a solid line). The user 152 may use a selector 410 to select the first indicator and to drag the first indicator to a new taxiing route. The GUI 400 may indicate the new taxiing route using a second indicator (e.g., a dotted line) in response to receiving the user input 120 of FIG. 1 indicating that the user 152 dragged and dropped the first indicator at the new taxiing route. In FIG. 4, the new taxiing route is indicated by a routing path 420.

For example, in response to identifying a potential conflict between the other aircraft 320 and the aircraft 206, the user 152 may drag and drop a first indicator representing the taxiing route assignment 146 to generate a new taxiing route represented by the routing path 420. In response to receiving the user input 120 of FIG. 1 indicating that the user 152 dragged and dropped the first indicator, the airport traffic control system (such as the system 100 of FIG. 1) may automatically modify the taxiing route assignment 146 and may generate a textual representation of the modified taxiing route assignment 146 as indicated at a text box 422 of the GUI 400.

The textual representation may indicate that the aircraft 206 identified as AL505 is to modify the previously assigned taxiing route to include a first waypoint (e.g., a taxiway D) rather than a second waypoint (e.g., a taxiway E) as previously assigned. After dragging and dropping the first indicator to modify the taxiing route assignment 146, and after the textual representation of the modified taxiing route assignment 146 is automatically generated, the airport traffic controller (e.g., the user 152) may select the selectable input 230 to transmit the textual representation of the modified taxiing route assignment 146 to the aircraft 206.

In a particular embodiment, the user 152 may modify the taxiing route assignment 146 by entering (or modifying) the textual representation in the text box 422. In a particular embodiment, the user 152 may modify the taxiing route assignment 146 by selecting one or more waypoints displayed by the GUI 400. For example, the user 152 may use the selector 410 to select a location in the text box 422 and to select the one or more waypoints. In response to receiving the selection (e.g., the user input 120) of the one or more waypoints, the route management module 140 may modify the textual representation in the text box 422 by adding a representation of the one or more waypoints at the selected location in the text box 422. As another example, the user 152 may use an input device (e.g., a keyboard) to provide a textual input (e.g., the user input 120) to modify the textual representation in the text box 422.

In a particular embodiment, the route management module 140 of FIG. 1 may automatically detect a conflict between the taxiing route assignment 146 and another object. For example, the route management module 140 may detect whether a first path (or a portion of the first path) corresponding to the taxiing route assignment 146 is inaccessible based on the conditions 148, as described with reference to FIG. 2. As another example, the route management module 140 may detect that another taxiing route assignment associated with another vehicle (e.g., the aircraft 320) includes the first path (or a portion of the first path), as described with reference to FIG. 2. In a particular embodiment, the route management module 140 may periodically analyze the conditions 148, the taxiing route assignment 146, other taxiing route assignments, or a combination thereof, to detect potential conflicts.

The route management module 140 may automatically select a second path in response to detecting that the first path (or a portion of the first path) is inaccessible, that the other taxiing route assignment includes the first path (or a portion of the first path), or both, as described with reference to FIG. 2. The route management module 140 may modify the taxiing route assignment 146 to correspond to the second path. In a particular embodiment, the route management module 140 may display an alert on the GUI 300 to indicate that a conflict is detected. For example, the route management module 140 may display the aircraft 320 in a different color in response to detecting a conflict between the taxiing route assignment 146 and the aircraft 320. In a particular embodiment, the route management module 140 may update the descriptor 212 to have a particular value (e.g., "Conflict") indicating a detected conflict.

In a particular embodiment, after the taxiing route assignment 146 is modified (regardless of how the taxiing route assignment 146 is modified), both the textual representation in the text box 422, and the one or more graphical elements (graphically representing the taxiing route assignment 146 on the graphical layout of an airport) may be updated to indicate the modified taxiing route assignment 146. The user 152 may select the selectable input 230 subsequent to the modification of the textual representation in the text box 422.

In response to receiving a selection of the selectable input 230, the route management module 140 may automatically send the taxiing routing message 186 to the aircraft 206 (e.g., the vehicle 102). The route management module 140 may update the descriptor 212 to have a particular value (e.g., "TC SENT") indicating that the taxiing routing message 186 has been sent. The taxiing routing message 186 may indicate the modified taxiing route assignment 146. For example, the taxiing routing message 186 may include the textual representation of the taxiing route assignment 146.

Accordingly, the pilot or other crew (e.g., control crew or support crew) associated with the aircraft 206 may be alerted to the modified taxiing route assignment 146 in response to receiving the taxiing routing message 186. Additionally, the route management module 140 may update the status 150 of the aircraft 206 (e.g., the vehicle 102) to indicate that the taxiing routing message 186 has been transmitted to the aircraft 206 and is yet to be acknowledged. In response to the pilot or other crew acknowledging the modified taxiing route assignment 146 (e.g., by selecting an input at a display of the aircraft 206, by pressing a button, or both), the aircraft 206 may transmit the acknowledgment 184 to the device 104. In response to receiving the acknowledgment 184, the route management module 140 may update the status 150 to a particular value (e.g., TC acknowledged) that indicates that the modified taxiing route assignment 146 has been acknowledged by the aircraft 206 (e.g., the vehicle 102).

Accordingly, the GUI 400 may enable the user 152 to identify reasons (e.g., conflicts) to modify routing (e.g., the taxiing route assignment 146) and may facilitate modifying the routing, e.g., by dragging and dropping a first indicator representing the taxiing route assignment 146, by designating a waypoint, by entering text at the text box 422, or a combination thereof. Additionally, automatic population of the text box 422 by the aircraft traffic control system (e.g., the system 100) and automatic updating of a graphical representation of the taxiing route assignment may reduce the opportunity for user error compared to the user 152 entering text in the text box 422.

Figure 5:
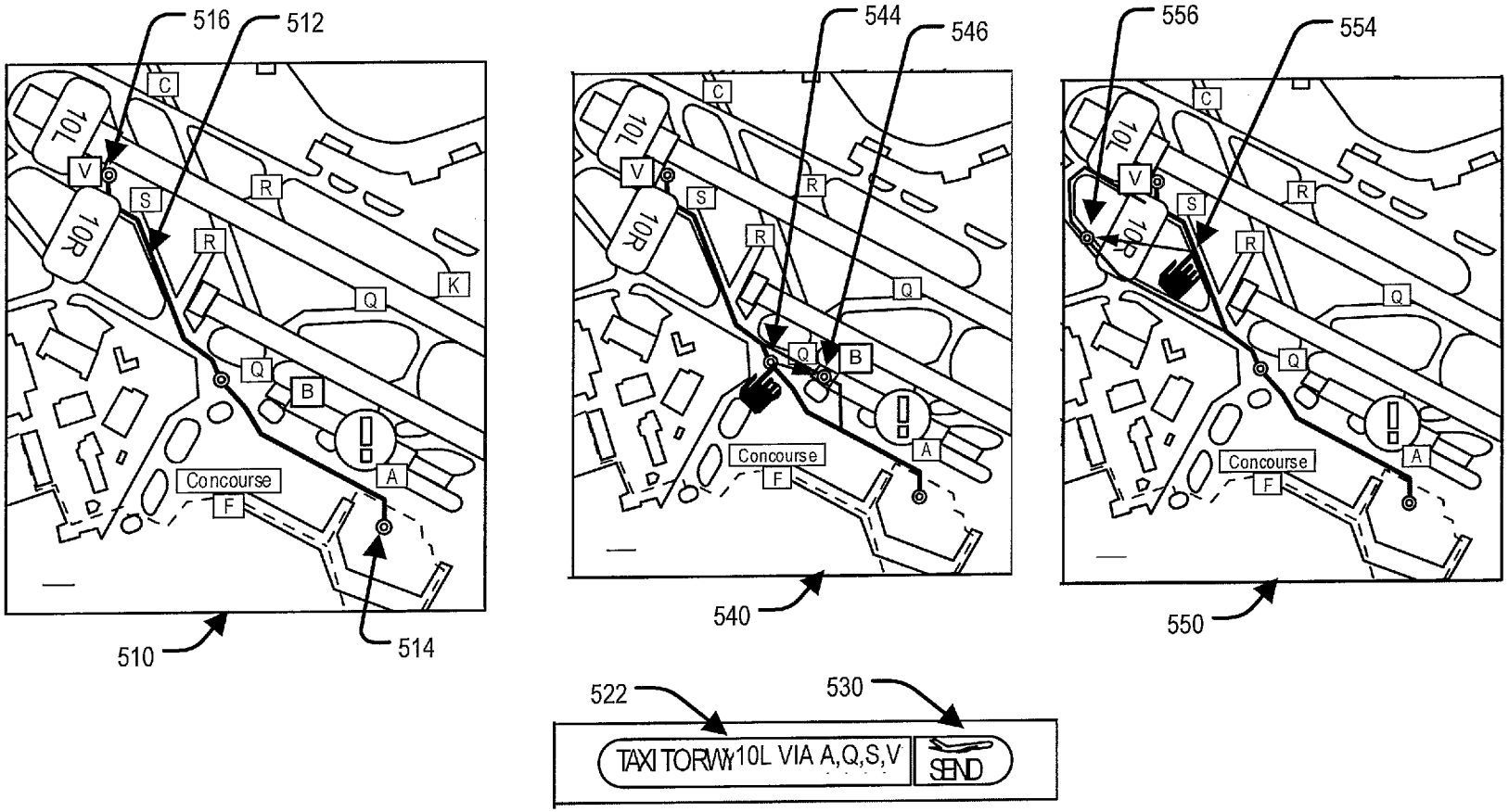
FIG. 5 is a diagram of another particular embodiment of a graphical user interface that may be generated by the system of FIG. 1.

Referring to FIG. 5, particular embodiments of graphical user interfaces (GUIs) are shown. In a particular embodiment, the GUIs of FIG. 5 may be generated by the route management module 140 of FIG. 1. In a particular embodiment, the GUI 500 may correspond to the GUI 130 of FIG. 1.

The GUIs of FIG. 5 illustrate multiple methods that may be used to modify proposed taxiing route assignments (e.g., the taxiing route assignment 146 of FIG. 1). In a particular embodiment, the route management module 140 may modify the taxiing route assignment 146 in response to receiving the user input 120 of FIG. 1. In an alternate embodiment, the route management module 140 may modify the taxiing route assignment 146 for other reasons, such as for efficiency, to avoid obstacles, and/or to reduce risk.

A display provided to a controller may include one or more of the GUIs 510, 540, 550. The GUI 500 may also include a text box 522, a selectable input 530, or both. The GUI 510 illustrates a particular embodiment of a taxiing route assignment (e.g., the taxiing route assignment 146) shown on a graphical layout of an airport. The GUI 510 may include a first indicator 512 (e.g., a solid line) that represents the taxiing route assignment 146. The first indicator 512 may correspond to a vehicle (e.g., the vehicle 102 of FIG. 1, the aircraft 206 of FIG. 2, or both) taxiing from a first location 514 to a second location 516.

An airport traffic control system (e.g., the system 100, the route management module 140 of FIG. 1, or both) may generate the taxiing route assignment 146 automatically or based on input (e.g., the user input 120 of FIG. 1) received from a controller (e.g., the user 152). The route management module 140 may assign the taxiing route assignment 146 to the vehicle 102 of FIG. 1 (e.g., the aircraft 206 of FIG. 2) or may propose the taxiing route assignment 146.

The user 152 or the route management module 140 may populate the text box 522 with text corresponding to the taxiing route assignment 146. The text may indicate waypoints, taxiways, or other identifiers that correspond to the taxiing route assignment 146. The first indicator 512 may correspond to the text in the text box 522.

In a particular embodiment, the user 152 may populate the text box 522 with text corresponding to a portion of the taxiing route assignment 146. For example, the user 152 may use an input device (e.g., a keyboard) to populate the text box 522 with the text. The text may indicate waypoints, taxiways, or other identifiers that are to be included in the taxiing route assignment 146. In a particular embodiment, the user 152 may populate the text box 522 by selecting an indicator corresponding to a waypoint, a taxiway, or another identifier. For example, the user 152 may use an input device (e.g., a mouse or a touchscreen) to select an indicator corresponding to a particular starting location (e.g., the first location 514), to select an indicator corresponding to a particular intermediate location, to select an indicator corresponding to a particular end location (e.g., the second location 516), or a combination thereof. The route management module 140 may populate the text box 522 with text corresponding to the selected indicators. For example, the route management module 140 may populate the text box 522 with text corresponding to the first location 514 in response to receiving the selection of the indicator corresponding to the first location 514. As another example, the route management module 140 may populate the text box 522 with text corresponding to the second location 516 in response to receiving the selection of the indicator corresponding to the second location 516.

The route management module 140 may determine the taxiing route assignment 146 based on the text. For example, the text may indicate a particular start location, a particular end location, and a particular intermediate location. The route management module 140 may identify a path from the particular start location, via the particular intermediate location, to the particular end location based on the routing rules 144, the conditions 148, and taxiing route assignments of other vehicles, as described with reference to FIG. 2. The path may include one or more additional locations than specified in the text of the text box 522. The taxiing route assignment 146 may correspond to the identified path. The route management module 140 may update the text of the text box 522 to indicate the taxiing route assignment 146 corresponding to the identified path.

The user 152 or the route management module 140 may update the text of the text box 522 to modify the taxiing route assignment 146, as described with reference to FIG. 4. For example, the user 152 may edit the text of the text box 522, such as by using an input device (e.g., a keyboard) to provide the user input 120. As another example, the route management module 140 may update the text of the text box 522, such as in response to detecting a conflict with a taxiing route assignment of another vehicle. To illustrate, rather than the vehicle 102 (e.g., the aircraft 206) taxiing to a first runway (e.g., a runway 10 or 10L) via a first path (e.g., a path including waypoints AQSV), the updated text may indicate the vehicle 102 (e.g., the aircraft 206) taxiing to the first runway via a second path (e.g., a path including ABQSV). In a particular embodiment, the second path may include a first waypoint (e.g., a taxiway B) that is excluded from the first path, may exclude a second waypoint that is included in the first path, or both. The updated text may indicate that the taxiing route assignment 146 is to be modified to include the first waypoint, exclude the second waypoint, or both.

Alternatively, as indicated in the GUI 540, a user (e.g., the user 152 of FIG. 1) may select a first waypoint (e.g., a waypoint 544) along the first indicator 512 and may drag and drop the selected waypoint at another waypoint location (e.g., a waypoint location 546). In response to user 152 dragging and dropping the waypoint 544 to the waypoint location 546, the route management module 140 may automatically update text of the text box 522 to indicate that the taxiing route assignment 146 is to include the waypoint location 546.

As another example, as indicated in the GUI 550, a user (the user 152 of FIG. 1) may select a portion (e.g., a portion 554) of the first indicator 512 and may drag and drop the portion 554 at another location (e.g., a location 556) of the graphical layout of the airport. In response to the user 152 dragging and dropping the portion 554 at the location 556, the route management module 140 may automatically update text of the text box 522 to indicate that the taxiing route assignment 146 is to include the location 556.

Regardless of the method used to update the text of the text box 522 (e.g., by editing the text in the text box 522, by dragging and dropping the waypoint 544, or by dragging or dropping the portion 554), the route management module 140 may update (or generate) the taxiing route assignment 146 corresponding to the text of the text box 522. The user 152 may select the selectable input 530. In response to receiving the selection of the selectable input 530, the route management module 140 may provide (e.g., transmit) the taxiing routing message 186 to the vehicle 102 (e.g., the aircraft 206). The taxiing routing message 186 may indicate the updated taxiing route assignment 146.

Thus, FIG. 5 illustrates multiple mechanisms that may be used by an airport traffic control system (e.g., the route management module 140) or a controller (e.g., the user 152) to assign, modify, and display taxiing route assignments (e.g., the taxiing route assignment 146) of a vehicle (e.g., the vehicle 102) at an airport. By enabling multiple mechanisms to enter and modify taxiing route assignments, the airport traffic control system may simplify tasks of the user 152 as well as reduce opportunities for user error, such as errors in generating the taxiing routing messages (e.g., the taxiing routing message 186). Additionally, when the user 152 enters text corresponding to a taxiing route assignment (e.g., the taxiing route assignment 146) in the text box 522, the graphical representation of the airport may automatically illustrate the effect of the changed text on the taxiing route assignment 146 such as by graphically illustrating the modified taxiing route assignment 146 to reduce user error.

Figure 6:
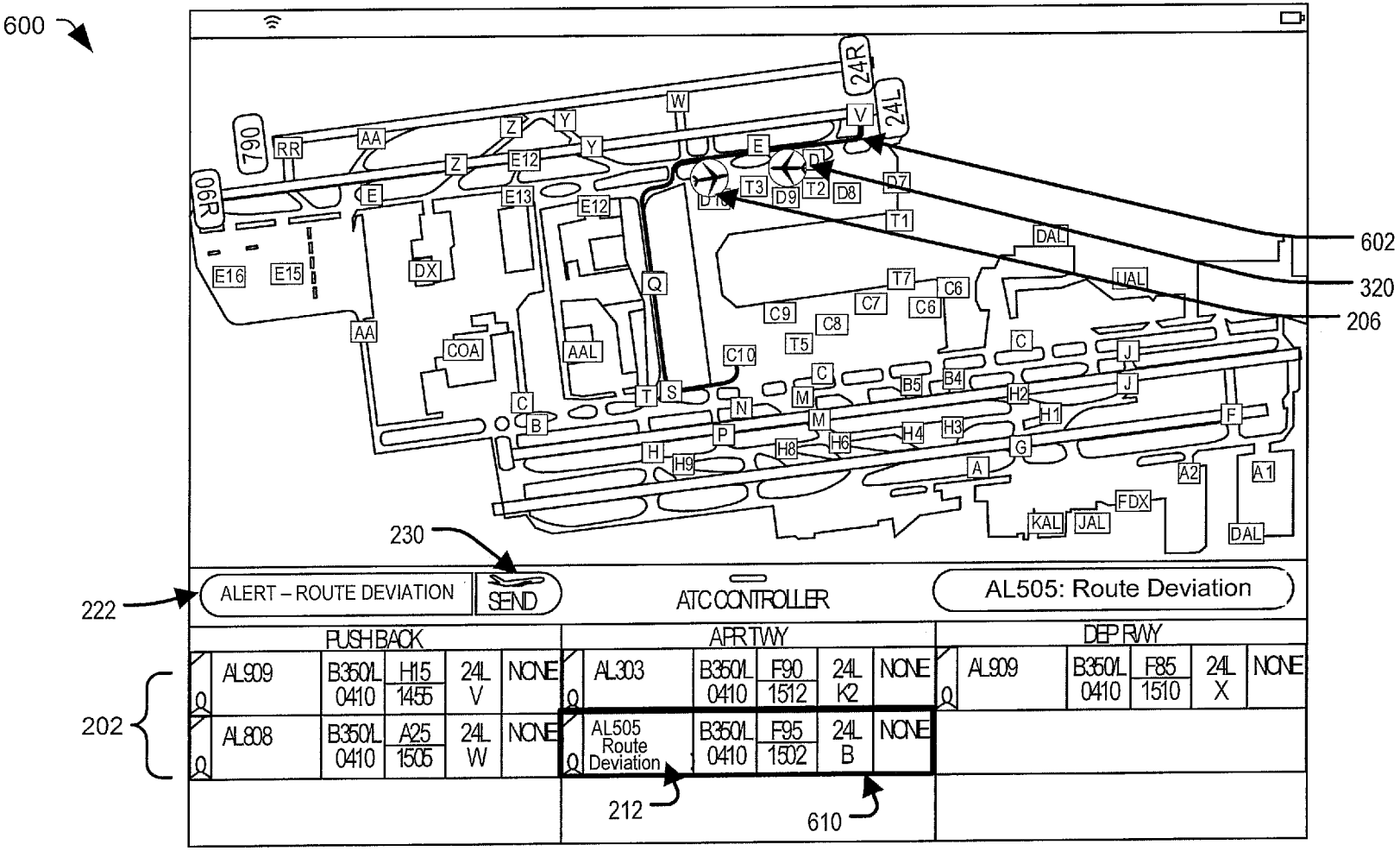
FIG. 6 is a diagram of another particular embodiment of a graphical user interface that may be generated by the system of FIG. 1

Referring to FIG. 6, a graphical user interface (GUI) is shown and generally designated 600. In a particular embodiment, the GUI 600 may be generated by the route management module 140 of FIG. 1. In a particular embodiment, the GUI 600 may correspond to the GUI 130 of FIG. 1.

The route management module 140 may generate the GUI 600 in response to detecting an alert condition, as described herein. As illustrated in FIG. 6, the GUI 600 may include an alert message 610. The alert message 610 may be presented in the e-strip display portion 202.

In the particular example illustrated, the alert condition corresponds to the aircraft 206 deviating from a taxiing route assignment (e.g., the taxiing route assignment 146) associated with the aircraft 206. For example, the route management module 140 may receive a location update from the aircraft 206, from another device (e.g., a sensor at the airport), or both. The location update may indicate that the aircraft 206 is detected proximate to a particular waypoint. In a particular embodiment, the location update may indicate a heading (e.g., a compass heading, such as north, north-west, west, etc.) of the aircraft 206, a speed of the aircraft 206, or both. The route management module 140 may detect the alert condition based on a comparison of the location update and the taxiing route assignment 146. For example, route management module 140 may detect that the aircraft 206 has departed from the taxiing route assignment 146 in response to determining that the taxiing route assignment 146 excludes the particular waypoint, that the taxiing route assignment 146 indicates a different heading than indicated by the location update, that the taxiing route assignment 146 indicates a different speed than indicated by the location update, or a combination thereof.

The indicator 602 may represent the taxiing route assignment 146. The route management module 140 may generate (or update) the e-strip display portion 202 to visually alert a user (e.g., the user 152) in response to detecting the alert condition. In a particular embodiment, the route management module 140 may use color coding, flashing, or other highlighting mechanism to draw attention of the user 152 to the alert condition. Additionally, the route management module 140 may update a status (e.g., the status 150) associated with the aircraft 206 to provide information about the alert condition. The route management module 140 may update the descriptor 212 to have a particular value (e.g., "Route Deviation") indicating the detected alert condition (e.g., a route deviation).

Additionally, the airport traffic control system ((e.g., the route management module 140, the system 100, or both, of FIG. 1) may generate an alert message that may be transmitted to the aircraft 206. The route management module 140 may automatically send the alert message to the aircraft 206 in response to detecting the alert condition or may send the alert message to the aircraft 206 in response to receiving a confirmation from the user 152. The route management module 140 may generate (or update) the GUI 600 to include a textual representation of the alert condition. For example, the route management module 140 may populate the text box 222 with alert text in response to detecting the alert condition. The alert text may indicate the alert condition. As illustrated in FIG. 6, the alert text may include particular keywords (e.g., "ALERT" and "ROUTE DEVIATION") in response to the route management module 140 detecting a particular alert condition (e.g., a route deviation). In a particular embodiment, the route management module 140 may generate (or update) the GUI 600 to include a graphical representation of the alert condition on the graphical layout of the airport.

The user 152 may edit the alert text in the text box 222, such as by providing the user input 120 of FIG. 1 via an input device (e.g., a keyboard). The user 152 may select the selectable input 230, e.g., to indicate acceptance of the alert text and to initiate transmission of an alert message to the aircraft 206. In response to receiving the selection of the selectable input 230, the route management module 140 may send an alert message to the aircraft 206 and the alert message may include the alert text of the text box 222.

Thus, the GUI 600 may enable the user 152 (e.g., an airport traffic controller) to be alerted to potentially hazardous conditions (e.g., the route deviation) and may enable an airport traffic control system (e.g., the route management module 140) to take steps automatically or in response to user input to rectify the alert conditions. For example, the airport traffic control system (e.g., the route management module 140) may automatically send the alert message to inform the aircraft 206 of the alert condition or may prompt the controller (e.g., the user 152) to alert the aircraft 206 of the alert condition. To illustrate, the route management module 140 may prompt the user 152 by populating the text box 222 with appropriate text to send to the aircraft 206.

In a particular embodiment, the aircraft traffic control system (e.g., the route management module 140) may also alert another aircraft (e.g., the other aircraft 320) if the other aircraft (e.g., the aircraft 320) is affected by the alert condition. In the example illustrated in FIG. 6, the aircraft 206 has deviated from the taxiing route assignment 146 represented by the indicator 602 to a portion of a route assigned to the other aircraft 320. In a particular embodiment, the route management module 140 may automatically alert the other aircraft 320 of the route deviation by the aircraft 206. For example, the route management module 140 may automatically send an alert message to the other aircraft 320 in response to detecting the alert condition (e.g., route deviation) associated with the aircraft 206. The alert message to the other aircraft 320 may indicate the alert condition and may identify the aircraft 206.

An airport traffic controller (e.g., the user 152 or another controller) viewing an e strips display (e.g., the e-strip display portion 202 of FIG. 2 or another e-strip display portion) may be alerted of the alert condition. For example, the user 152 or another airport traffic controller may be assigned to control (or manage) the aircraft 320. In order to improve safety, a first airport traffic controller assigned to control the aircraft 320 may be notified of the alert condition associated with the aircraft 206 even though the first airport traffic controller may not be assigned to control the aircraft 206. The airport traffic controller (e.g., the user 152 or another controller) may edit text corresponding to the alert condition and may select a selectable input (e.g., the selectable input 230). The route management module 140 may send an alert message to the aircraft 320 in response to receiving the selection of the selectable input (e.g., the selectable input 230). The alert message may indicate the aircraft 206, the aircraft 320, the alert condition (e.g., route deviation), or a combination thereof.

Figure 7:
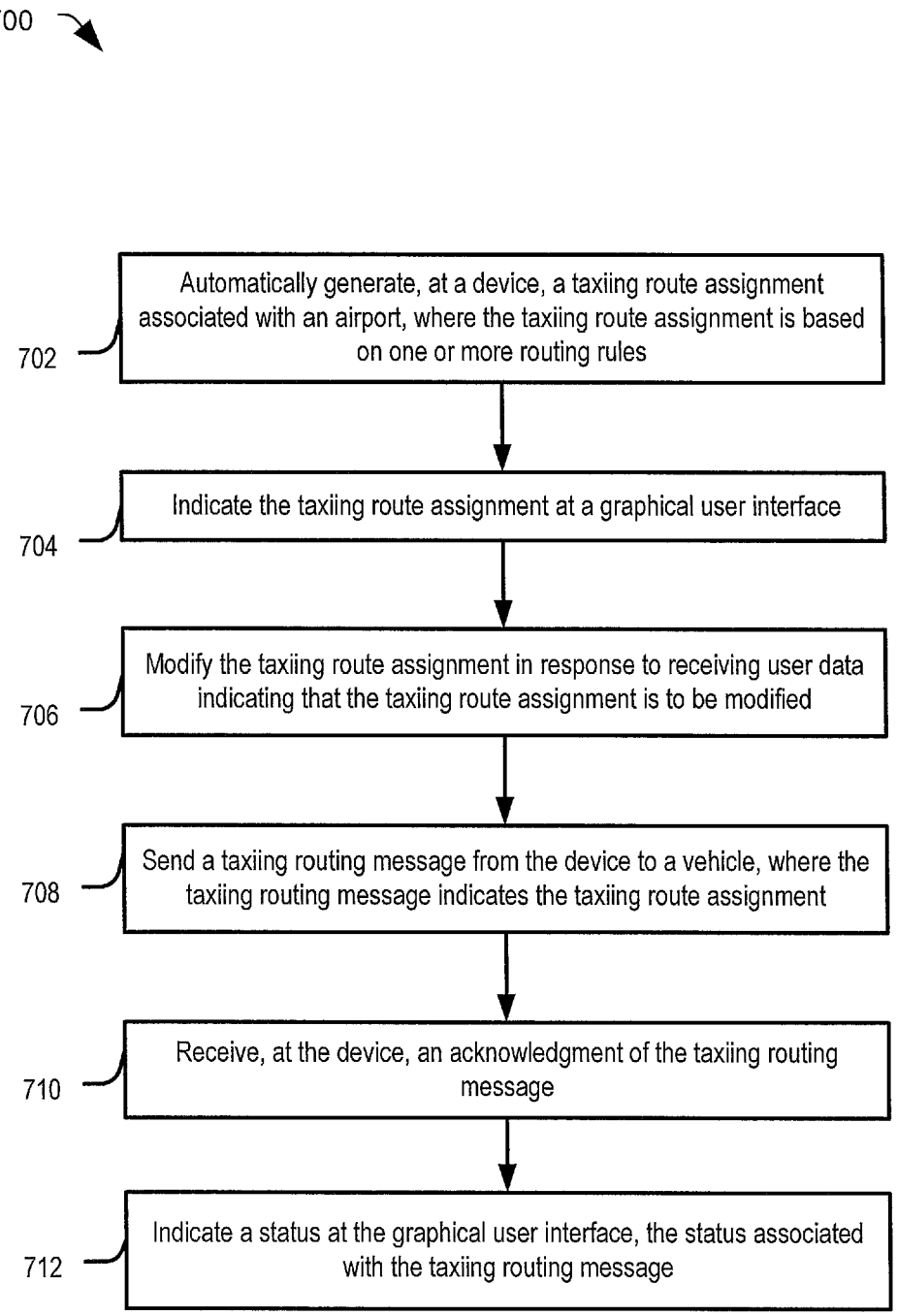
FIG. 7 is a flow chart illustrating a particular embodiment of a method of performing air traffic control.

Referring to FIG. 7, a flow chart of a particular embodiment of a method of performing air traffic control is shown and generally designated 700. In a particular embodiment, the method 700 may be performed by the system 100, the route management module 140, or both, of FIG. 1.

The method 700 includes automatically generating, at a device, a taxiing route assignment associated with an airport, at 702. The taxiing route assignment may be based on one or more routing rules. For example, the route management module 140 of FIG. 1 at the device 104 may generate the taxiing route assignment 146 associated with an airport, as described with reference to FIG. 1. The taxiing route assignment 146 may be based on the routing rules 144, as described with reference to FIG. 1.

The method 700 also includes indicating the taxiing route assignment at a graphical user interface, at 704. For example, the route management module 140 of FIG. 1 may generate at least one of the GUIs, as described with reference to FIGS. 1-6. The at least one of the GUIs may indicate the taxiing route assignment 146.

The method 700 also includes modifying the taxiing route assignment in response to receiving user data indicating that the taxiing route assignment is to be modified, at 706. For example, the route management module 140 of FIG. 1 may modify the taxiing route assignment 146 in response to receiving user input (e.g., the user input 120 or input generated using drag and drop functionality) indicating a modification of the taxiing route assignment, as described with reference to FIGS. 4-5.

The method 700 further includes sending a taxiing routing message from the device to a vehicle, at 708. The taxiing routing message may indicate the taxiing route assignment. For example, the route management module 140 of FIG. 1 may send the taxiing routing message 186 from the device 104 to the vehicle 102 (e.g., the aircraft 206), as described with reference to FIGS. 1-5.

The method 700 also includes receiving, at the device, an acknowledgment of the taxiing routing message, at 710. For example, the route management module 140 of FIG. 1 may receive at the device 104 the acknowledgment 184 of the taxiing routing message 186, as described with reference to FIGS. 1-4.

The method 700 further includes indicating a status at the graphical user interface, at 712. The status may be associated with the taxiing routing message. For example, the route management module 140 of FIG. 1 may generate the GUI 300 of FIG. 3 that indicates the status 150 associated with the taxiing routing message 186 based on the acknowledgment 184, as described with reference to FIG. 3.

Figure 8:
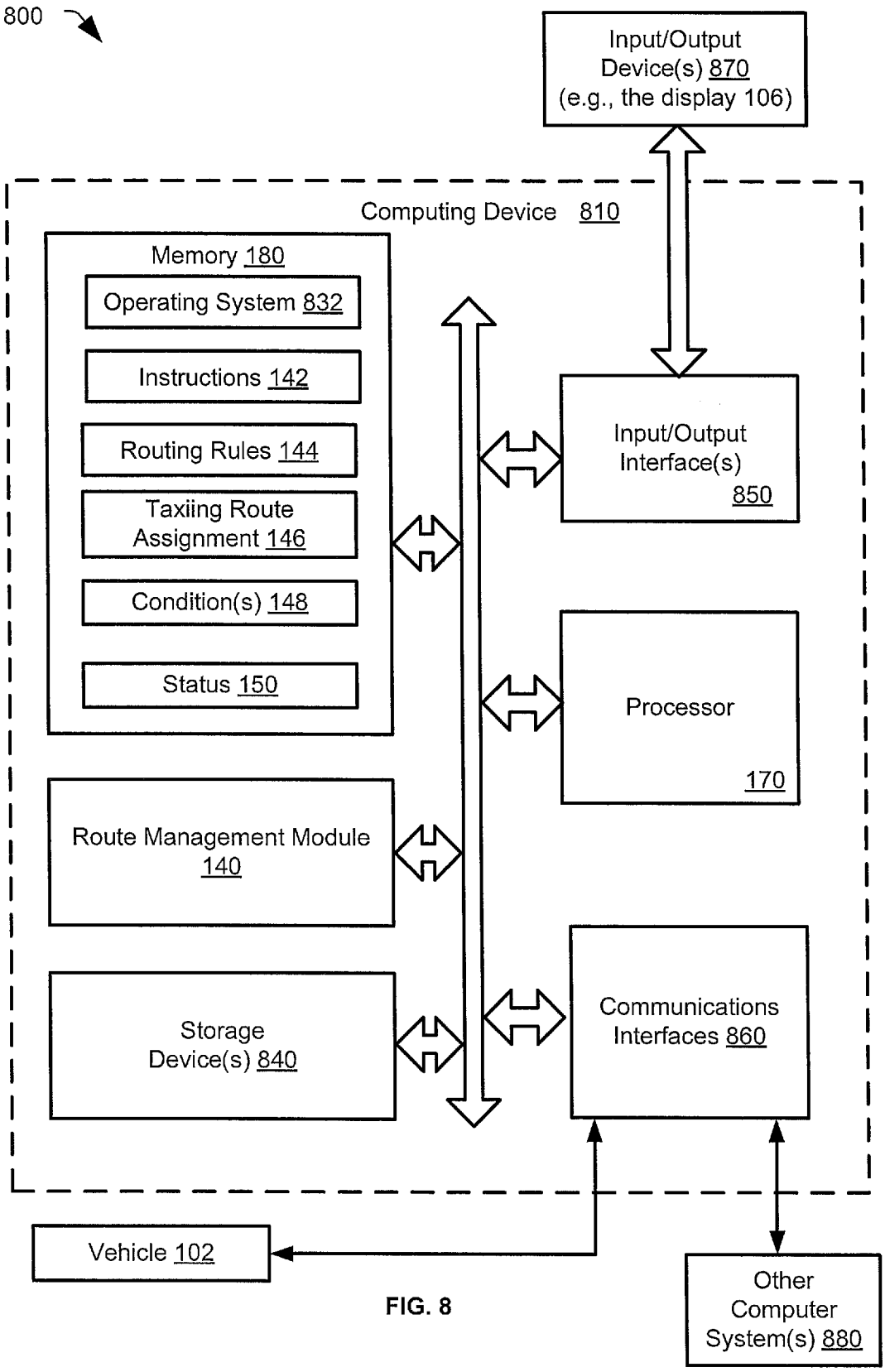
FIG. 8 is a block diagram of a particular illustrative embodiment of a computing environment to perform air traffic control.

Referring to FIG. 8, a block diagram of a computing environment is shown and generally designated 800. The computing environment 800 includes a general purpose computing device 810 to support embodiments of computer-implemented methods and computer-executable program instructions (or code) according to the present disclosure. For example, the computing device 810, or portions thereof, may execute instructions to facilitate control of airport traffic. In a particular embodiment, the computing device 810 may include, be included with, or correspond to the system 100 of FIG. 1.

The computing device 810 may include the processor 170 of FIG. 1. The processor 170 may communicate with the memory 180, the route management module 140 of FIG. 1, one or more storage devices 840, one or more input/output interfaces 850, one or more communications interfaces 860, or a combination thereof. In a particular embodiment, the route management module 140 is instructions (e.g., the instructions 142) stored in the memory 180 and executable by the processor 170 to perform functions, methods, and/or operations described with respect to FIGS. 1-7.

The memory 180 may include volatile memory devices (e.g., random access memory (RAM) devices), nonvolatile memory devices (e.g., read-only memory (ROM) devices, programmable read-only memory, and flash memory), or both. The memory 180 may include an operating system 832, which may include a basic/input output system for booting the computing device 810 as well as a full operating system to enable the computing device 810 to interact with users (e.g., the user 152 of FIG. 1), other programs, and other devices. The memory 180 may include one or more application programs 834, such as an airport traffic control application, e.g., an application that is executable to control traffic at an airport. The memory 180 may include the instructions 142 of FIG. 1, which may be executable by the processor 170, e.g., instructions that are executable to control airport traffic.

The processor 170 may also communicate with one or more storage devices 840. For example, the one or more storage devices 840 may include nonvolatile storage devices, such as magnetic disks, optical disks, or flash memory devices. The storage devices 840 may include both removable and non-removable memory devices. The storage devices 840 may be configured to store an operating system, images of operating systems, applications, and program data. In a particular embodiment, the memory 180, the storage devices 840, or both, include tangible, non-transitory computer-readable media.

The processor 170 may also communicate with one or more input/output interfaces 850 that enable the computing device 810 to communicate with one or more input/output devices 870 to facilitate user interaction. The input/output interfaces 850 may include serial interfaces (e.g., universal serial bus (USB) interfaces or Institute of Electrical and Electronics Engineers (IEEE) 1394 interfaces), parallel interfaces, display adapters, audio adapters, and other interfaces. The input/output devices 870 may include keyboards, pointing devices, displays, speakers, microphones, touch screens, and other devices. The processor 170 may detect interaction events based on user input (e.g., the user input 120 of FIG. 1) received via the input/output interfaces 850. Additionally, the processor 170 may send a display (e.g., one or more of the GUIs described above) to a display device (e.g., the display 106 of FIG. 1) via the input/output interfaces 850.

The processor 170 may communicate with the vehicle 102 (e.g., the aircraft 206 of FIG. 2), other computer systems 880 (e.g., the aircraft 320 of FIG. 3), or a combination thereof, via the one or more communications interfaces 860. The one or more communications interfaces 860 may include wired Ethernet interfaces, IEEE 802 wireless interfaces, other wireless communication interfaces, or other network interfaces. For example, the processor 170 may communicate with one or more vehicles via the network 110 of FIG. 1. The other computer systems 880 may include host computers, servers, workstations, and other computing devices.

Thus, in particular embodiments, a computer system may facilitate airport traffic control. For example, the instructions 142 may be executable by the processor 170 to facilitate control of airport traffic by generating a taxiing route assignment and sending the taxiing route assignment to a vehicle.

Embodiments described above are illustrative and do not limit the disclosure. It is to be understood that numerous modifications and variations are possible in accordance with the principles of the present disclosure.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it is to be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to fewer than all of the features of any of the disclosed embodiments.

What is claimed is:

1. A method comprising:

sending a taxiing routing message from a first device to a vehicle, wherein the taxiing routing message indicates a route assignment associated with an airport;

in response to receiving an acknowledgment of the taxiing routing message from the vehicle, indicating a status at a graphical user interface, the status associated with the taxiing routing message;

in response to detecting that the vehicle has entered an area associated with a second device, sending a signal to the second device from the first device, wherein the signal indicates that the second device is to route the vehicle; and updating the graphical user interface to indicate that the vehicle is routed by the second device.

2. The method of claim 1, further comprising, in response to sending the taxiing routing message, indicating a second status at the graphical user interface, wherein the second status indicates that the route assignment has been sent.

3. The method of claim 1, wherein the vehicle includes a ground vehicle.

4. The method of claim 1, further comprising, prior to sending the taxiing routing message, automatically generating the route assignment based on routing rules.

5. The method of claim 4, further comprising, prior to sending the taxiing routing message:

indicating the route assignment at the graphical user interface after the route assignment has been automatically generated;

receiving user data indicating that the route assignment is to be modified; and modifying the route assignment based on the user data to generate a modified route assignment, wherein the taxiing routing message indicates the modified route assignment.

6. The method of claim 5, wherein the graphical user interface further includes a graphical layout of the airport, wherein the graphical user interface includes a first graphical representation of the route assignment on the graphical layout, and wherein the user data corresponds to a user selection of one or more graphical elements of the graphical layout.

7. The method of claim 4, wherein the routing rules indicate that a particular vehicle with a particular property is to be routed to a particular waypoint.

8. The method of claim 7, wherein the particular property is that the particular vehicle is arriving from an international flight, and wherein the particular waypoint is a gate in an immigration area of the airport.

9. A system comprising:

a processor; and a memory storing instructions that, when executed by the processor, cause the processor to perform operations comprising:

sending a taxiing routing message from a first device to a vehicle, wherein the taxiing routing message indicates a route assignment associated with an airport;

in response to receiving an acknowledgment of the taxiing routing message from the vehicle, indicating a status at a graphical user interface, the status associated with the taxiing routing message, in response to detecting that the vehicle has entered an area associated with a second device, sending a signal to the second device from the first device, wherein the signal indicates that the second device is to route the vehicle; and updating the graphical user interface to indicate that the vehicle is routed by the second device.

10. The system of claim 9, wherein the operations further comprise indicating an alert at the graphical user interface in response to detecting the vehicle diverting from the route assignment.

11. The system of claim 10, wherein the graphical user interface includes a textual representation of the alert.

12. The system of claim 10, wherein the graphical user interface includes a graphical layout of the airport and wherein the graphical user interface indicates a graphical representation of the alert on the graphical layout.

13. The system of claim 9, wherein the vehicle includes an aircraft or a ground vehicle.

14. The system of claim 9, wherein the status indicates that the route assignment is accepted.

15. The system of claim 14, wherein the operations further comprise:

in response to receiving a taxiing request from the vehicle:

indicating a second status at the graphical user interface, the second status associated with the taxiing routing message, wherein the second status indicates that the route assignment is rejected;

automatically generating a second route assignment based on routing rules;

indicating the second route assignment at the graphical user interface; and sending a second taxiing routing message to the vehicle in response to receiving a user input, wherein the second taxiing routing message indicates the second route assignment.

16. The system of claim 9, wherein the graphical user interface further indicates a gate assignment corresponding to the vehicle.

17. A non-transitory computer-readable storage device storing instructions, that when executed by a processor, cause the processor to perform operations comprising:

sending a first taxiing routing message from a first device to a first vehicle, wherein the first taxiing routing message indicates a first route assignment associated with an airport;

in response to receiving an acknowledgment of the first taxiing routing message, indicating a status at a graphical user interface, the status associated with the first taxiing routing message, in response to detecting that the first vehicle has entered an area associated with a second device, sending a signal to the second device from the first device, wherein the signal indicates that the second device is to route the vehicle; and updating the graphical user interface to indicate that the first vehicle is routed by the second device.

18. The non-transitory computer-readable storage device of claim 17, wherein the operations further comprise:

indicating an alert at the graphical user interface in response to detecting a conflict between the first route assignment and a location of a second vehicle at the airport;

automatically generating a second route assignment based on routing rules; and indicating the second route assignment at the graphical user interface.

19. The non-transitory computer-readable storage device of claim 18, wherein the operations further comprise, in response to receiving a user input, sending a second taxiing routing message to the first vehicle, wherein the second taxiing routing message indicates the second route assignment.

20. The method of claim 1, further comprising, in response to detecting the vehicle diverting from the route assignment, indicating an alert at the graphical user interface.

21. A method comprising:

automatically generating a route assignment based on routing rules;

sending a taxiing routing message from a device to a vehicle, wherein the taxiing routing message indicates the route assignment associated with an airport; and in response to receiving an acknowledgment of the taxiing routing message from the vehicle, indicating a status at a graphical user interface, the status associated with the taxiing routing message, wherein the routing rules indicate that a particular vehicle with a particular property is to be routed to a particular waypoint, and wherein the particular property is that the particular vehicle is arriving from an international flight, and wherein the particular waypoint is a gate in an immigration area of the airport.

22. A system comprising:

a processor; and a memory storing instructions that, when executed by the processor, cause the processor to perform operations comprising:

sending a taxiing routing message to a vehicle, wherein the taxiing routing message indicates a route assignment associated with an airport; and in response to receiving an acknowledgment of the taxiing routing message from the vehicle, indicating a status at a graphical user interface, the status associated with the taxiing routing message, wherein the status indicates that the route assignment is accepted, and wherein the operations further comprise, in response to receiving a taxiing request from the vehicle:

indicating a second status at the graphical user interface, the second status associated with the taxiing routing message, wherein the second status indicates that the route assignment is rejected;

automatically generating a second route assignment based on routing rules;

indicating the second route assignment at the graphical user interface; and sending a second taxiing routing message to the vehicle in response to receiving a user input, wherein the second taxiing routing message indicates the second route assignment.

* * * * *